US011318425B2

(12) United States Patent
Yamada et al.

(10) Patent No.: US 11,318,425 B2
(45) Date of Patent: May 3, 2022

(54) ULTRAFINE BUBBLE-CONTAINING LIQUID PRODUCING APPARATUS AND ULTRAFINE BUBBLE-CONTAINING LIQUID PRODUCING METHOD

(71) Applicant: CANON KABUSHIKI KAISHA, Tokyo (JP)

(72) Inventors: Akitoshi Yamada, Kanagawa (JP); Masahiko Kubota, Tokyo (JP); Akira Yamamoto, Kanagawa (JP); Yoshiyuki Imanaka, Kanagawa (JP); Yumi Yanai, Kanagawa (JP); Hiroyuki Ishinaga, Tokyo (JP); Teruo Ozaki, Kanagawa (JP); Toshio Kashino, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/084,832

(22) Filed: Oct. 30, 2020

(65) Prior Publication Data

US 2021/0129090 A1 May 6, 2021

(30) Foreign Application Priority Data

Oct. 31, 2019 (JP) ..... JP2019-199386

(51) Int. Cl.
*B01F 3/04* (2006.01)

(52) U.S. Cl.
CPC ..... *B01F 3/04106* (2013.01); *B01F 3/04439* (2013.01); *B01F 3/04503* (2013.01); *B01F 2003/04858* (2013.01)

(58) Field of Classification Search
CPC ..... B01F 3/04106; B01F 3/04
See application file for complete search history.

(56) References Cited

U.S. PATENT DOCUMENTS

2007/0257381 A1* 11/2007 Chuang ..... B01F 5/12 261/76
2020/0197963 A1 6/2020 Takahashi et al.
(Continued)

FOREIGN PATENT DOCUMENTS

JP 2019042732 A 3/2019

OTHER PUBLICATIONS

Yamada et al., U.S. Appl. No. 17/084,920, filed Oct. 30, 2020.
(Continued)

*Primary Examiner* — Robert A Hopkins
(74) *Attorney, Agent, or Firm* — Venable LLP

(57) ABSTRACT

The apparatus includes: a producing unit that generates ultrafine bubbles in a liquid supplied from a liquid introducing unit to produce an ultrafine bubble-containing liquid containing the ultrafine bubbles, and delivers the ultrafine bubble-containing liquid; a liquid delivering unit that delivers the ultrafine bubble-containing liquid to an outside; a buffer tank that receives the liquid delivered from the producing unit and delivers the liquid to the liquid delivering unit; and a controller that controls the delivery of the ultrafine bubble-containing liquid from the buffer tank to the liquid delivering unit such that, if the producing unit stops operating, an ultrafine bubble-containing liquid accumulated in the buffer tank is delivered to the liquid delivering unit to enable the liquid delivering unit to deliver the ultrafine bubble-containing liquid to the outside.

15 Claims, 21 Drawing Sheets

(56) References Cited

U.S. PATENT DOCUMENTS

| | | | |
|---|---|---|---|
| 2020/0254468 | A1 | 8/2020 | Kubota et al. |
| 2020/0276511 | A1 | 9/2020 | Ozaki et al. |
| 2020/0276512 | A1 | 9/2020 | Ozaki et al. |
| 2020/0276513 | A1 | 9/2020 | Yanai et al. |
| 2020/0276514 | A1 | 9/2020 | Ishinaga et al. |
| 2020/0276515 | A1 | 9/2020 | Kubota et al. |
| 2020/0276516 | A1 | 9/2020 | Imanaka et al. |
| 2020/0276550 | A1 | 9/2020 | Imanaka et al. |
| 2020/0276803 | A1 | 9/2020 | Arimizu et al. |
| 2020/0276804 | A1 | 9/2020 | Kubota et al. |
| 2020/0278111 | A1 | 9/2020 | Imanaka et al. |

OTHER PUBLICATIONS

Imanaka et al., U.S. Appl. No. 17/084,801, filed Oct. 30, 2020.
Ozaki et al., U.S. Appl. No. 17/084,814, dated Oct. 30, 2020.
Yamamoto et al., U.S. Appl. No. 17/084,809, filed Oct. 30, 2020.

* cited by examiner

ULTRAFINE BUBBLE-CONTAINING LIQUID PRODUCING APPARATUS AND ULTRAFINE BUBBLE-CONTAINING LIQUID PRODUCING METHOD

BACKGROUND OF THE INVENTION

Field of the Invention

The present invention relates to an ultrafine bubble-containing liquid producing apparatus and an ultrafine bubble-containing liquid producing method for producing an ultrafine bubble-containing liquid containing ultrafine bubbles with a diameter of less than 1.0 μm.

Description of the Related Art

Recently, there have been developed techniques for applying the features of fine bubbles such as microbubbles in micrometer-size in diameter and nanobubbles in nanometer-size in diameter. Especially, the utility of ultrafine bubbles (hereinafter also referred to as "UFBs") smaller than 1.0 μm in diameter have been confirmed in various fields.

Japanese Patent Laid-Open No. 2019-042732 includes a route in which UFBs are generated by a UFB generator in a liquid supplied from a liquid introduction tank and then the UFB-containing liquid is delivered to a liquid delivery tank. Japanese Patent Laid-Open No. 2019-042732 further proposes raising the concentration of contained UFBs by forming a circulation route through which to return the liquid delivered to the liquid delivery tank back into the liquid introduction tank, and repetitively passing the UFB-containing liquid through the UFB generator.

SUMMARY OF THE INVENTION

However, the apparatus disclosed in Japanese Patent Laid-Open No. 2019-042732 has a problem in that in a case where a constituent element such as the UFB generator or a pump breaks during the production of a UFB-containing liquid, the generation of UFBs may be intermitted during replacement, repair, or the like of the broken element.

Thus, an object of the present invention is to provide a UFB-containing liquid producing apparatus and a UFB-containing liquid producing method capable of continuing supplying a UFB-containing liquid even in a case where a part of the apparatus malfunctions.

The present invention provides an ultrafine bubble-containing liquid producing apparatus including: a producing unit that generates ultrafine bubbles in a liquid supplied from a liquid introducing unit to thereby produce an ultrafine bubble-containing liquid containing the generated ultrafine bubbles, and delivers the produced ultrafine bubble-containing liquid; a liquid delivering unit that delivers the produced ultrafine bubble-containing liquid to an outside; a buffer tank that receives the liquid delivered from the producing unit and delivers the received liquid to the liquid delivering unit; and a controller that controls the delivery of the ultrafine bubble-containing liquid from the buffer tank to the liquid delivering unit such that, in a case where the producing unit stops operating, the ultrafine bubble-containing liquid accumulated in the buffer tank is delivered to the liquid delivering unit to thereby enable the liquid delivering unit to deliver the ultrafine bubble-containing liquid to the outside.

According to the present invention, it is possible to continue supplying a UFB-containing liquid even in a case where a part of the apparatus malfunctions.

Further features of the present invention will become apparent from the following description of exemplary embodiments with reference to the attached drawings.

DESCRIPTION OF THE EMBODIMENTS

Embodiments of the present invention will be described below with reference to the drawings.

<<Configuration of UFB Generating Apparatus>>

Figure 1:
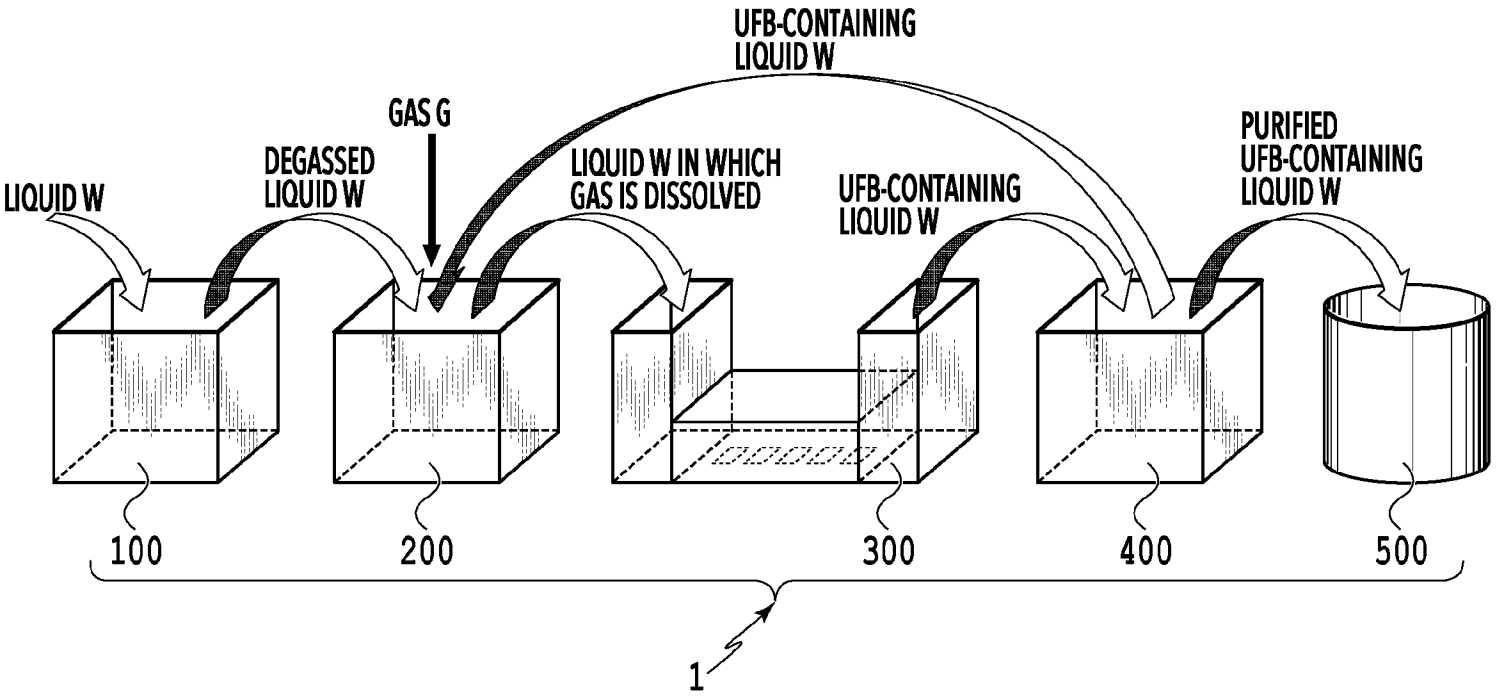
FIG. 1 is a diagram illustrating an example of a UFB generating apparatus.

FIG. 1 is a diagram illustrating an example of a UFB generating apparatus applicable to the present invention. A UFB generating apparatus 1 of this embodiment includes a pre-processing unit 100, dissolving unit 200, a T-UFB generating unit 300, a post-processing unit 400, and a collecting unit 500. Each unit performs unique processing on a liquid W such as tap water supplied to the pre-processing unit 100 in the above order, and the thus-processed liquid W is collected as a T-UFB-containing liquid by the collecting unit 500. Functions and configurations of the units are described below. Although details are described later, UFBs generated by utilizing the film boiling caused by rapid heating are referred to as thermal-ultrafine bubbles (T-UFBs) in this specification.

Figure 2:
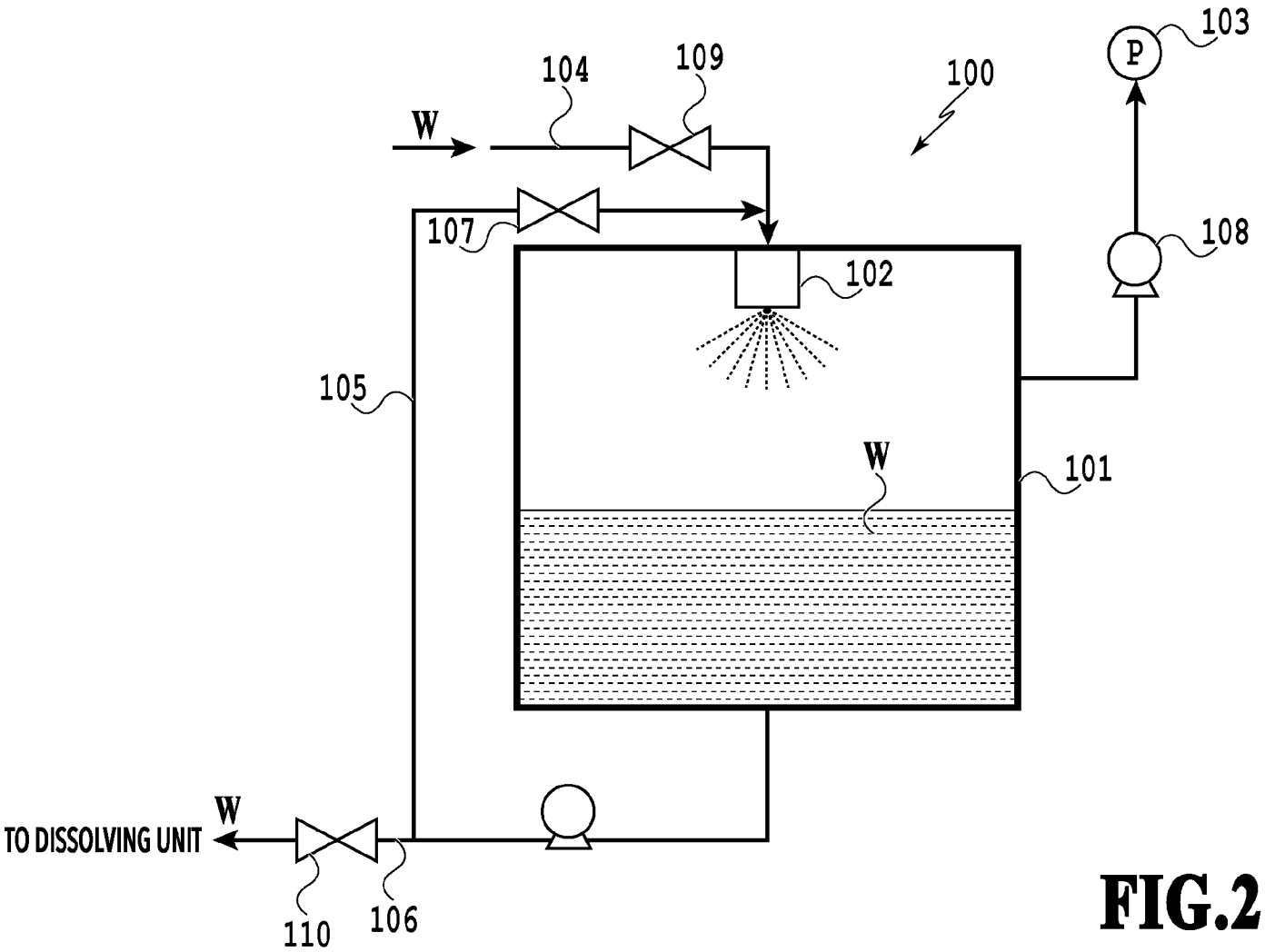
FIG. 2 is a schematic configuration diagram of a pre-processing unit.

FIG. 2 is a schematic configuration diagram of the pre-processing unit 100. The pre-processing unit 100 of this embodiment performs a degassing treatment on the supplied liquid W. The pre-processing unit 100 mainly includes a degassing container 101, a shower head 102, a depressurizing pump 103, a liquid introduction passage 104, a liquid circulation passage 105, and a liquid discharge passage 106. For example, the liquid W such as tap water is supplied to the degassing container 101 from the liquid introduction passage 104 through a valve 109. In this process, the shower head 102 provided in the degassing container 101 sprays a mist of the liquid W in the degassing container 101. The shower head 102 is for prompting the gasification of the liquid W; however, a centrifugal and the like may be used instead as the mechanism for producing the gasification prompt effect.

When a certain amount of the liquid W is reserved in the degassing container 101 and then the depressurizing pump 103 is activated with all the valves closed, already-gasified gas components are discharged, and gasification and discharge of gas components dissolved in the liquid W are also prompted. In this process, the internal pressure of the degassing container 101 may be depressurized to around several hundreds to thousands of Pa (1.0 Torr to 10.0 Torr) while checking a manometer 108. The gases to be removed by the pre-processing unit 100 includes nitrogen, oxygen, argon, carbon dioxide, and so on, for example.

The above-described degassing processing can be repeatedly performed on the same liquid W by utilizing the liquid circulation passage 105. Specifically, the shower head 102 is operated with the valve 109 of the liquid introduction passage 104 and a valve 110 of the liquid discharge passage 106 closed and a valve 107 of the liquid circulation passage 105 opened. This allows the liquid W reserved in the degassing container 101 and degassed once to be resprayed in the degassing container 101 from the shower head 102. In addition, with the depressurizing pump 103 operated, the gasification processing by the shower head 102 and the degassing processing by the depressurizing pump 103 are repeatedly performed on the same liquid W. Every time the above processing utilizing the liquid circulation passage 105 is performed repeatedly, it is possible to decrease the gas components contained in the liquid W in stages. Once the liquid W degassed to a desired purity is obtained, the liquid W is transferred to the dissolving unit 200 through the liquid discharge passage 106 with the valve 110 opened.

FIG. 2 illustrates the degassing unit 100 that depressurizes the gas part to gasify the solute; however, the method of degassing the solution is not limited thereto. For example, a heating and boiling method for boiling the liquid W to gasify the solute may be employed, or a film degassing method for increasing the interface between the liquid and the gas using hollow fibers. A SEPAREL series (produced by DIC corporation) is commercially supplied as the degassing module using the hollow fibers. The SEPAREL series uses poly(4-methylpentene-1) (PMP) for the raw material of the hollow fibers and is used for removing air bubbles from ink and the like mainly supplied for a piezo head. In addition, two or more of an evacuating method, the heating and boiling method, and the film degassing method may be used together.

Figure 3A:
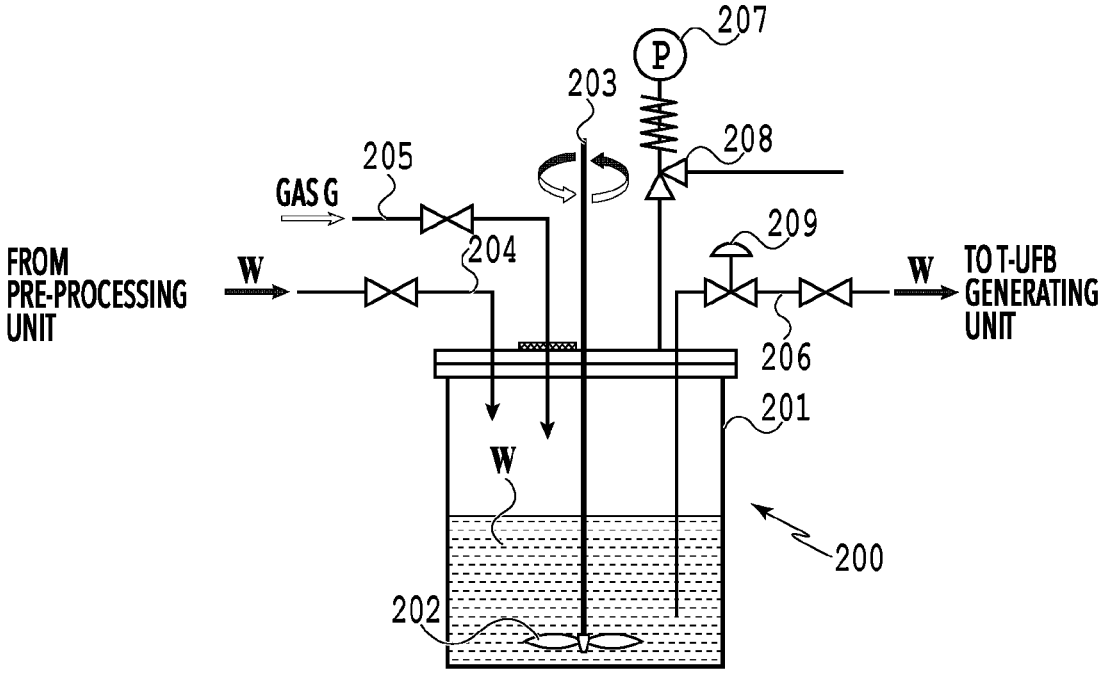
FIGS. 3A and 3B are a schematic configuration diagram of a dissolving unit and a diagram for describing the dissolving states in a liquid.
Figure 3B:
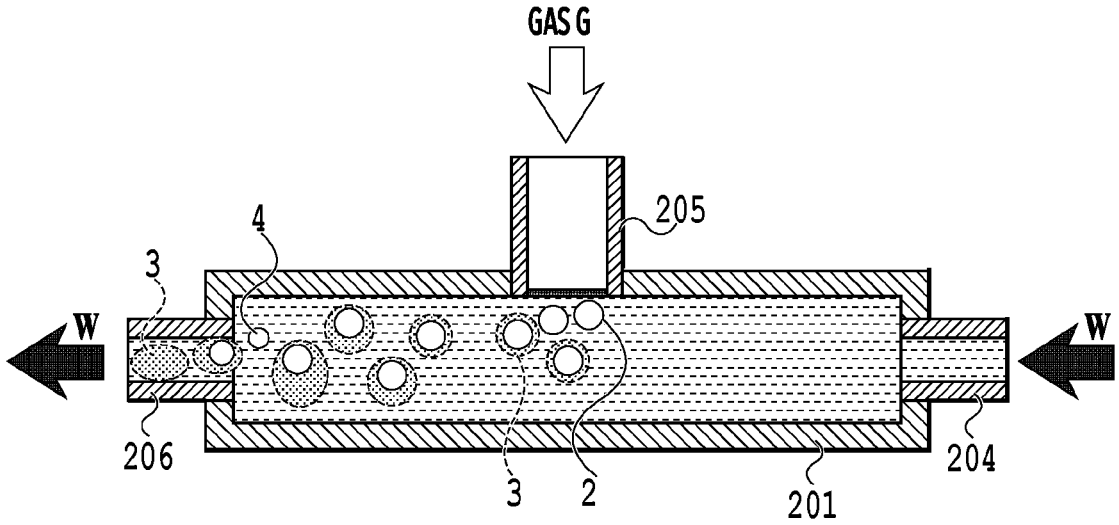

FIGS. 3A and 3B are a schematic configuration diagram of the dissolving unit 200 and a diagram for describing the dissolving states in the liquid. The dissolving unit 200 is a unit for dissolving a desired gas into the liquid W supplied from the pre-processing unit 100. The dissolving unit 200 of this embodiment mainly includes a dissolving container 201, a rotation shaft 203 provided with a rotation plate 202, a liquid introduction passage 204, a gas introduction passage 205, a liquid discharge passage 206, and a pressurizing pump 207.

The liquid W supplied from the pre-processing unit 100 is supplied into the dissolving container 201 from the liquid introduction passage 204 through a liquid introduction opening-closing valve and stored in the dissolving container 201. On the other hand, a gas G is supplied into the dissolving container 201 from the gas introduction passage 205 through a gas introduction opening-closing valve.

Once predetermined amounts of the liquid W and the gas G are reserved in the dissolving container 201, the pressurizing pump 207 is activated to increase the internal pressure of the dissolving container 201 to about 0.5 MPa. A safety valve 208 is arranged between the pressurizing pump 207 and the dissolving container 201. With the rotation plate 202 in the liquid rotated via the rotation shaft 203, the gas G supplied to the dissolving container 201 is transformed into air bubbles, and the contact area between the gas G and the liquid W is increased to prompt the dissolution into the liquid W. This operation is continued until the solubility of the gas G reaches almost the maximum saturation solubility. In this case, a unit for decreasing the temperature of the liquid may be provided to dissolve the gas as much as possible. When the gas is with low solubility, it is also possible to increase the internal pressure of the dissolving container 201 to 0.5 MPa or higher. In this case, the material and the like of the container need to be the optimum for safety sake.

Once the liquid Win which the components of the gas G are dissolved at a desired concentration is obtained, the liquid W is discharged through the liquid discharge passage 206 and supplied to the T-UFB generating unit 300. In this process, a back-pressure valve 209 adjusts the flow pressure of the liquid W to prevent excessive increase of the pressure during the supplying.

FIG. 3B is a diagram schematically illustrating the dissolving states of the gas G put in the dissolving container 201. An air bubble 2 containing the components of the gas G put in the liquid W is dissolved from a portion in contact with the liquid W. The air bubble 2 thus shrinks gradually, and a gas-dissolved liquid 3 then appears around the air bubble 2. Since the air bubble 2 is affected by the buoyancy, the air bubble 2 may be moved to a position away from the center of the gas-dissolved liquid 3 or be separated out from the gas-dissolved liquid 3 to become a residual air bubble 4. Specifically, in the liquid W to be supplied to the T-UFB generating unit 300 through the liquid discharge passage 206, there is a mix of the air bubbles 2 surrounded by the gas-dissolved liquids 3 and the air bubbles 2 and the gas-dissolved liquids 3 separated from each other.

The gas-dissolved liquid 3 in the drawings means "a region of the liquid W in which the dissolution concentration of the gas G mixed therein is relatively high." In the gas components actually dissolved in the liquid W, the concentration of the gas components in the gas-dissolved liquid 3 is the highest at a portion surrounding the air bubble 2. In a case where the gas-dissolved liquid 3 is separated from the air bubble 2 the concentration of the gas components of the gas-dissolved liquid 3 is the highest at the center of the region, and the concentration is continuously decreased as away from the center. That is, although the region of the gas-dissolved liquid 3 is surrounded by a broken line in FIG. 3 for the sake of explanation, such a clear boundary does not actually exist. In addition, in the present invention, a gas that cannot be dissolved completely may be accepted to exist in the form of an air bubble in the liquid.

Figure 4:
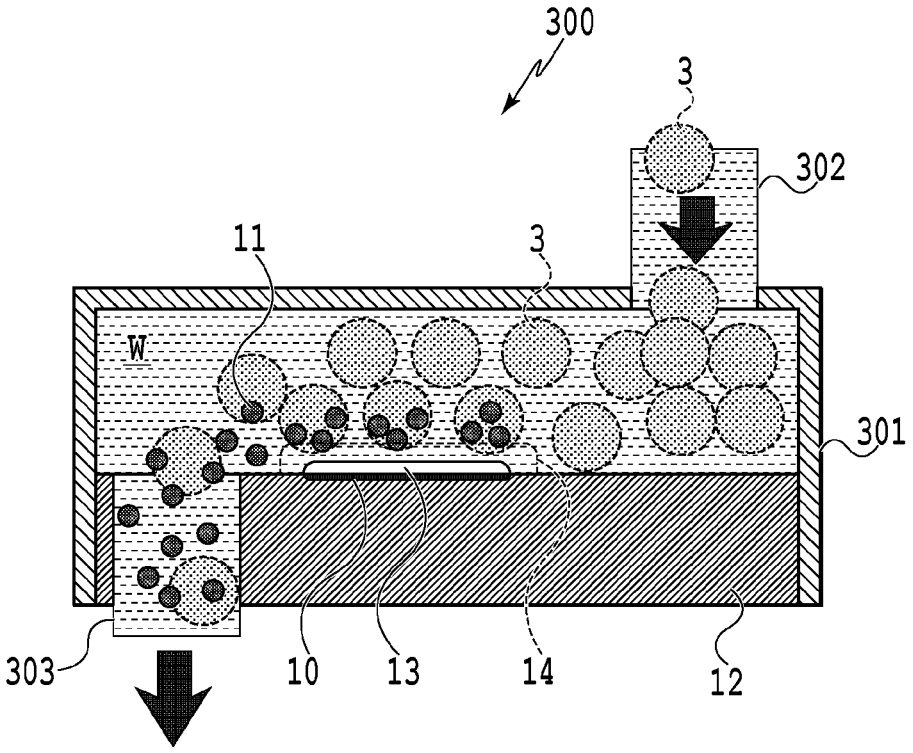
FIG. 4 is a schematic configuration diagram of a T-UFB generating unit.

FIG. 4 is a schematic configuration diagram of the T-UFB generating unit 300. The T-UFB generating unit 300 mainly includes a chamber 301, a liquid introduction passage 302, and a liquid discharge passage 303. The flow from the liquid introduction passage 302 to the liquid discharge passage 303 through the chamber 301 is formed by a not-illustrated flow pump. Various pumps including a diaphragm pump, a gear pump, and a screw pump may be employed as the flow pump. In in the liquid W introduced from the liquid introduction passage 302, the gas-dissolved liquid 3 of the gas G put by the dissolving unit 200 is mixed.

An element substrate 12 provided with a heating element 10 is arranged on a bottom section of the chamber 301. With a predetermined voltage pulse applied to the heating element 10, a bubble 13 generated by the film boiling (hereinafter, also referred to as a film boiling bubble 13) is generated in a region in contact with the heating element 10. Then, an ultrafine bubble (UFB) 11 containing the gas G is generated caused by expansion and shrinkage of the film boiling bubble 13. As a result, a UFB-containing liquid W containing many UFBs 11 is discharged from the liquid discharge passage 303.

Figure 5A:
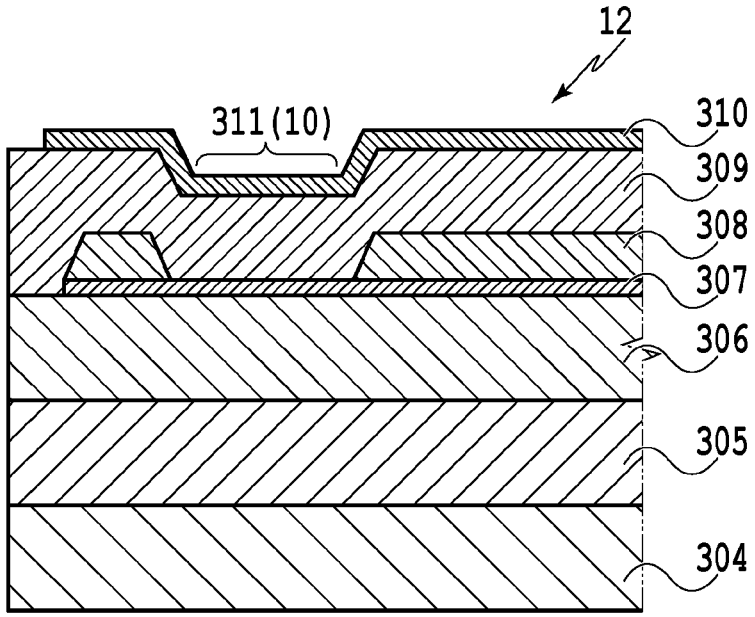
FIGS. 5A and 5B are diagrams for describing details of a heating element.
Figure 5B:
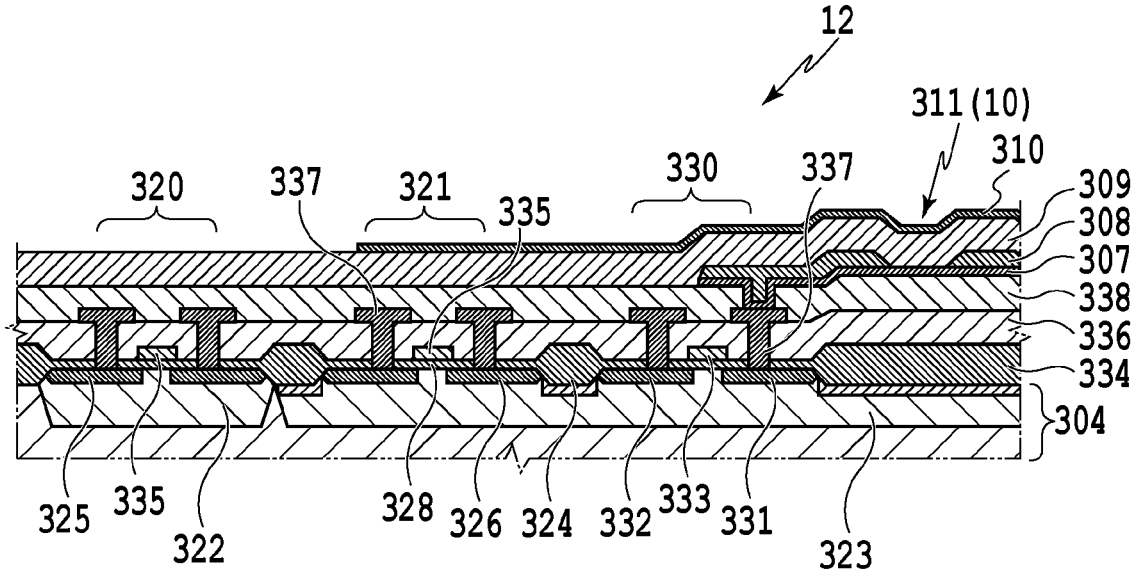

FIGS. 5A and 5B are diagrams for illustrating a detailed configuration of the heating element 10. FIG. 5A illustrates a closeup view of the heating element 10, and FIG. 5B illustrates a cross-sectional view of a wider region of the element substrate 12 including the heating element 10.

As illustrated in FIG. 5A, in the element substrate 12 of this embodiment, a thermal oxide film 305 as a heat-accumulating layer and an interlaminar film 306 also served as a heat-accumulating layer are laminated on a surface of a silicon substrate 304. An $SiO_2$ film or an SiN film may be used as the interlaminar film 306. A resistive layer 307 is formed on a surface of the interlaminar film 306, and a wiring 308 is partially formed on a surface of the resistive layer 307. An Al-alloy wiring of Al, Al—Si, Al—Cu, or the like may be used as the wiring 308. A protective layer 309 made of an $SiO_2$ film or an $Si_3N_4$ film is formed on surfaces of the wiring 308, the resistive layer 307, and the interlaminar film 306.

A cavitation-resistant film 310 for protecting the protective layer 309 from chemical and physical impacts due to the heat evolved by the resistive layer 307 is formed on a portion and around the portion on the surface of the protective layer 309, the portion corresponding to a heat-acting portion 311 that eventually becomes the heating element 10. A region on the surface of the resistive layer 307 in which the wiring 308 is not formed is the heat-acting portion 311 in which the resistive layer 307 evolves heat. The heating portion of the resistive layer 307 on which the wiring 308 is not formed functions as the heating element (heater) 10. As described above, the layers in the element substrate 12 are sequentially formed on the surface of the silicon substrate 304 by a semiconductor production technique, and the heat-acting portion 311 is thus provided on the silicon substrate 304.

The configuration illustrated in the drawings is an example, and various other configurations are applicable. For example, a configuration in which the laminating order of the resistive layer 307 and the wiring 308 is opposite, and a configuration in which an electrode is connected to a lower surface of the resistive layer 307 (so-called a plug electrode configuration) are applicable. In other words, as described later, any configuration may be applied as long as the configuration allows the heat-acting portion 311 to heat the liquid for generating the film boiling in the liquid.

FIG. 5B is an example of a cross-sectional view of a region including a circuit connected to the wiring 308 in the element substrate 12. An N-type well region 322 and a P-type well region 323 are partially provided in a top layer of the silicon substrate 304, which is a P-type conductor. AP-MOS 320 is formed in the N-type well region 322 and an N-MOS 321 is formed in the P-type well region 323 by introduction and diffusion of impurities by the ion implantation and the like in the general MOS process.

The P-MOS 320 includes a source region 325 and a drain region 326 formed by partial introduction of N-type or P-type impurities in a top layer of the N-type well region 322, a gate wiring 335, and so on. The gate wiring 335 is deposited on a part of a top surface of the N-type well region 322 excluding the source region 325 and the drain region 326, with a gate insulation film 328 of several hundreds of A in thickness interposed between the gate wiring 335 and the top surface of the N-type well region 322.

The N-MOS 321 includes the source region 325 and the drain region 326 formed by partial introduction of N-type or P-type impurities in a top layer of the P-type well region 323, the gate wiring 335, and so on. The gate wiring 335 is deposited on a part of a top surface of the P-type well region 323 excluding the source region 325 and the drain region 326, with the gate insulation film 328 of several hundreds of A in thickness interposed between the gate wiring 335 and the top surface of the P-type well region 323. The gate wiring 335 is made of polysilicon of 3000 Å to 5000 Å in thickness deposited by the CVD method. A C-MOS logic is constructed with the P-MOS 320 and the N-MOS 321.

In the P-type well region 323, an N-MOS transistor 330 for driving an electrothermal conversion element (heating resistance element) is formed on a portion different from the portion including the N-MOS 321. The N-MOS transistor 330 includes a source region 332 and a drain region 331 partially provided in the top layer of the P-type well region 323 by the steps of introduction and diffusion of impurities, a gate wiring 333, and so on. The gate wiring 333 is deposited on a part of the top surface of the P-type well region 323 excluding the source region 332 and the drain region 331, with the gate insulation film 328 interposed between the gate wiring 333 and the top surface of the P-type well region 323.

In this example, the N-MOS transistor 330 is used as the transistor for driving the electrothermal conversion element. However, the transistor for driving is not limited to the N-MOS transistor 330, and any transistor may be used as long as the transistor has a capability of driving multiple electrothermal conversion elements individually and can implement the above-described fine configuration. Although the electrothermal conversion element and the transistor for driving the electrothermal conversion element are formed on the same substrate in this example, those may be formed on different substrates separately.

An oxide film separation region 324 is formed by field oxidation of 5000 Å to 10000 Å in thickness between the elements, such as between the P-MOS 320 and the N-MOS 321 and between the N-MOS 321 and the N-MOS transistor 330. The oxide film separation region 324 separates the elements. A portion of the oxide film separation region 324 corresponding to the heat-acting portion 311 functions as a heat-accumulating layer 334, which is the first layer on the silicon substrate 304.

An interlayer insulation film 336 including a PSG film, a BPSG film, or the like of about 7000 Å in thickness is formed by the CVD method on each surface of the elements such as the P-MOS 320, the N-MOS 321, and the N-MOS transistor 330. After the interlayer insulation film 336 is made flat by heat treatment, an Al electrode 337 as a first wiring layer is formed in a contact hole penetrating through the interlayer insulation film 336 and the gate insulation film 328. On surfaces of the interlayer insulation film 336 and the Al electrode 337, an interlayer insulation film 338 including an $SiO_2$ film of 10000 Å to 15000 Å in thickness is formed by a plasma CVD method. On the surface of the interlayer insulation film 338, a resistive layer 307 including a TaSiN film of about 500 Å in thickness is formed by a co-sputter method on portions corresponding to the heat-acting portion 311 and the N-MOS transistor 330. The resistive layer 307 is electrically connected with the Al electrode 337 near the drain region 331 via a through-hole formed in the interlayer insulation film 338. On the surface of the resistive layer 307, the wiring 308 of Al as a second wiring layer for a wiring to each electrothermal conversion element is formed. The protective layer 309 on the surfaces of the wiring 308, the resistive layer 307, and the interlayer insulation film 338 includes an SiN film of 3000 Å in thickness formed by the plasma CVD method. The cavitation-resistant film 310 deposited on the surface of the protective layer 309 includes a thin film of about 2000 Å in thickness, which is at least one metal selected from the group consisting of Ta, Fe, Ni, Cr, Ge, Ru, Zr, Ir, and the like. Various materials other than the above-described TaSiN such as $TaN_{0.8}$, CrSiN, TaAl, WSiN, and the like can be applied as long as the material can generate the film boiling in the liquid.

Figure 6A:
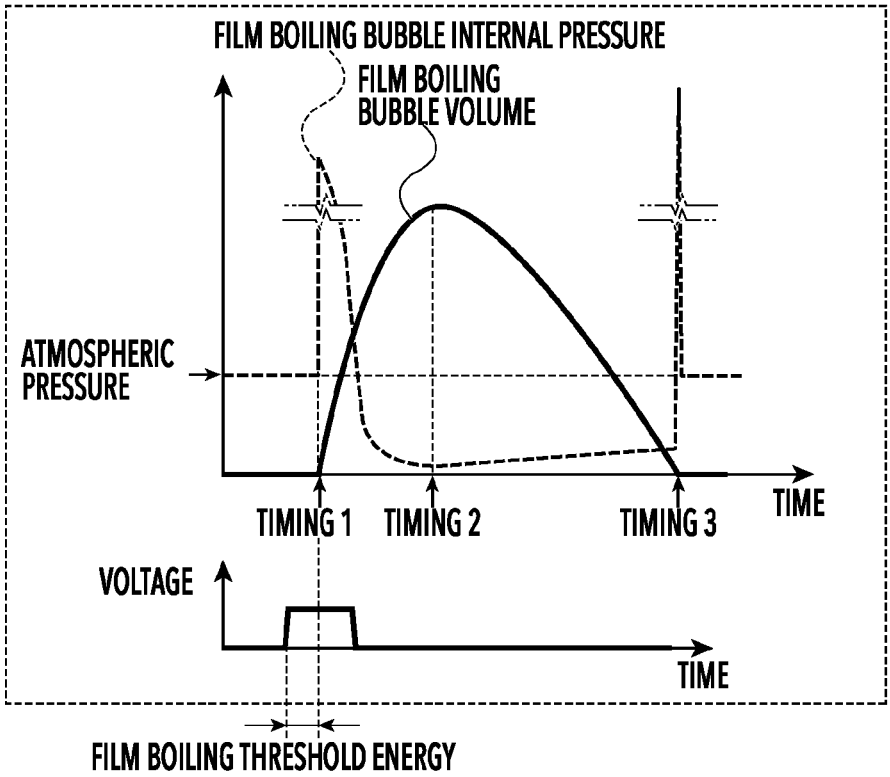
FIGS. 6A and 6B are diagrams for describing the states of film boiling on the heating element.
Figure 6B:
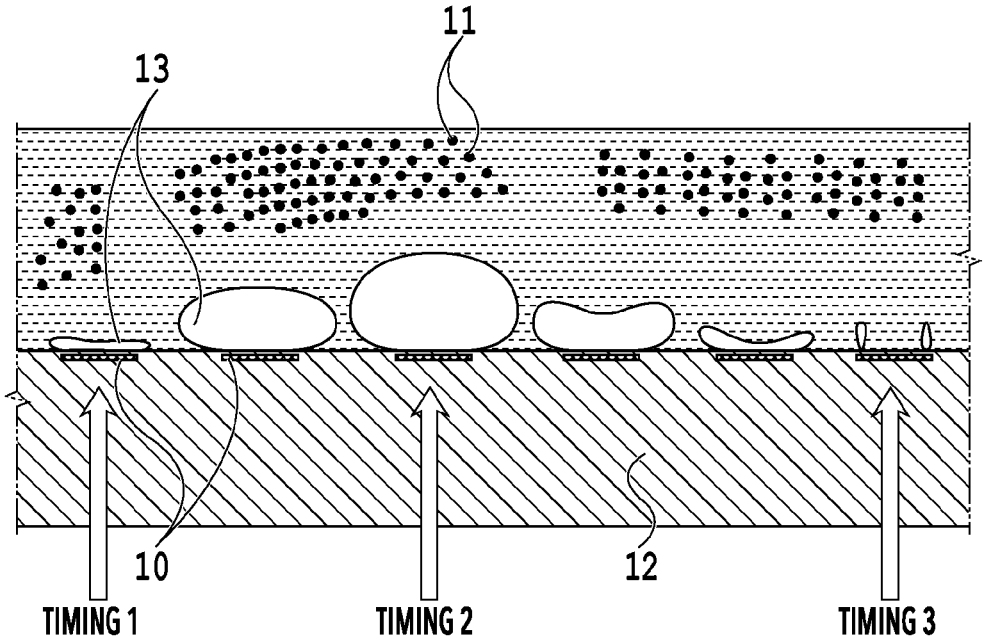

FIGS. 6A and 6B are diagrams illustrating the states of the film boiling when a predetermined voltage pulse is applied to the heating element 10. In this case, the case of generating the film boiling under atmospheric pressure is described. In FIG. 6A, the horizontal axis represents time. The vertical axis in the lower graph represents a voltage applied to the heating element 10, and the vertical axis in the upper graph represents the volume and the internal pressure of the film boiling bubble 13 generated by the film boiling. On the other hand, FIG. 6B illustrates the states of the film boiling bubble 13 in association with timings 1 to 3 shown in FIG. 6A. Each of the states is described below in chronological order. The UFBs 11 generated by the film boiling as described later are mainly generated near a surface of the film boiling bubble 13. The states illustrated in FIG. 6B are the states where the UFBs 11 generated by the generating unit 300 are resupplied to the dissolving unit 200 through the circulation route, and the liquid containing the UFBs 11 is resupplied to the liquid passage of the generating unit 300, as illustrated in FIG. 1.

Before a voltage is applied to the heating element 10, the atmospheric pressure is substantially maintained in the chamber 301. Once a voltage is applied to the heating element 10, the film boiling is generated in the liquid in contact with the heating element 10, and a thus-generated air bubble (hereinafter, referred to as the film boiling bubble 13) is expanded by a high pressure acting from inside (timing 1). A bubbling pressure in this process is expected to be around 8 to 10 MPa, which is a value close to a saturation vapor pressure of water.

The time for applying a voltage (pulse width) is around 0.5 μsec to 10.0 μsec, and the film boiling bubble 13 is expanded by the inertia of the pressure obtained in timing 1 even after the voltage application. However, a negative pressure generated with the expansion is gradually increased inside the film boiling bubble 13, and the negative pressure acts in a direction to shrink the film boiling bubble 13. After a while, the volume of the film boiling bubble 13 becomes the maximum in timing 2 when the inertial force and the negative pressure are balanced, and thereafter the film boiling bubble 13 shrinks rapidly by the negative pressure.

In the disappearance of the film boiling bubble 13, the film boiling bubble 13 disappears not in the entire surface of the heating element 10 but in one or more extremely small regions. For this reason, on the heating element 10, further greater force than that in the bubbling in timing 1 is generated in the extremely small region in which the film boiling bubble 13 disappears (timing 3).

The generation, expansion, shrinkage, and disappearance of the film boiling bubble 13 as described above are repeated every time a voltage pulse is applied to the heating element 10, and new UFBs 11 are generated each time.

The states of generation of the UFBs 11 in each process of the generation, expansion, shrinkage, and disappearance of the film boiling bubble 13 are further described in detail with reference to FIGS. 7A to 10B.

Figure 7A:
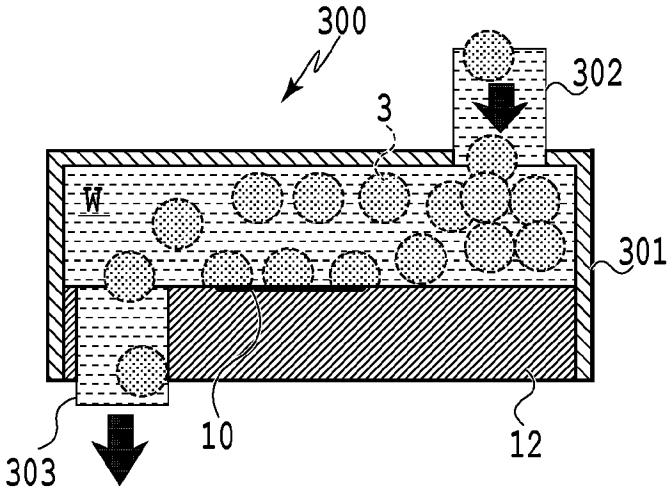
FIGS. 7A to 7D are diagrams illustrating the states of generation of UFBs caused by expansion of a film boiling bubble.

FIGS. 7A to 7D are diagrams schematically illustrating the states of generation of the UFBs 11 caused by the generation and the expansion of the film boiling bubble 13. FIG. 7A illustrates the state before the application of a voltage pulse to the heating element 10. The liquid W in which the gas-dissolved liquids 3 are mixed flows inside the chamber 301.

Figure 7B:
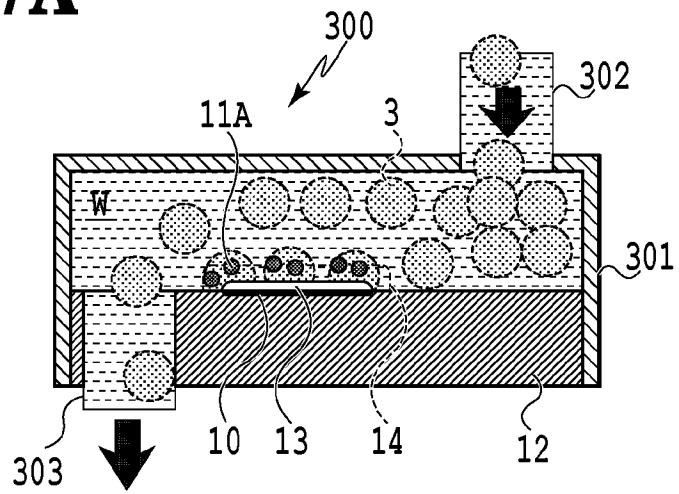

FIG. 7B illustrates the state where a voltage is applied to the heating element 10, and the film boiling bubble 13 is evenly generated in almost all over the region of the heating element 10 in contact with the liquid W. When a voltage is applied, the surface temperature of the heating element 10 rapidly increases at a speed of 10° C./pec. The film boiling occurs at a time point when the temperature reaches almost 300° C., and the film boiling bubble 13 is thus generated.

Thereafter, the surface temperature of the heating element 10 keeps increasing to around 600 to 800° C. during the pulse application, and the liquid around the film boiling bubble 13 is rapidly heated as well. In FIG. 7B, a region of the liquid that is around the film boiling bubble 13 and to be rapidly heated is indicated as a not-yet-bubbling high temperature region 14. The gas-dissolved liquid 3 within the not-yet-bubbling high temperature region 14 exceeds the thermal dissolution limit and is vaporized to become the UFB. The thus-vaporized air bubbles have diameters of around 10 nm to 100 nm and large gas-liquid interface energy. Thus, the air bubbles float independently in the liquid W without disappearing in a short time. In this embodiment, the air bubbles generated by the thermal action from the generation to the expansion of the film boiling bubble 13 are called first UFBs 11A.

Figure 7C:
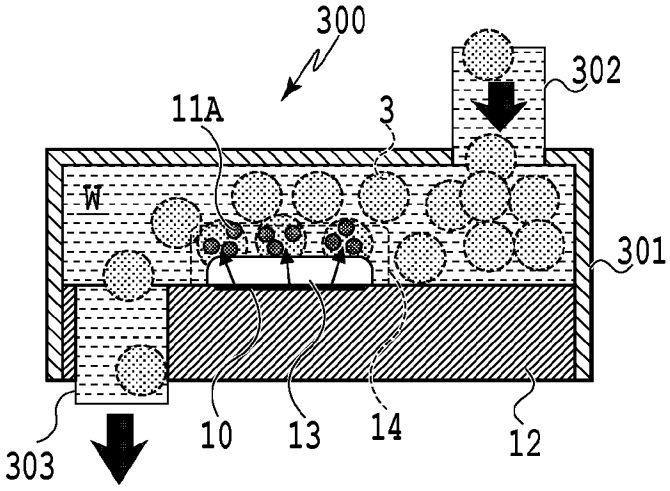

FIG. 7C illustrates the state where the film boiling bubble 13 is expanded. Even after the voltage pulse application to the heating element 10, the film boiling bubble 13 continues expansion by the inertia of the force obtained from the generation thereof, and the not-yet-bubbling high temperature region 14 is also moved and spread by the inertia. Specifically, in the process of the expansion of the film boiling bubble 13, the gas-dissolved liquid 3 within the not-yet-bubbling high temperature region 14 is vaporized as a new air bubble and becomes the first UFB 11A.

Figure 7D:
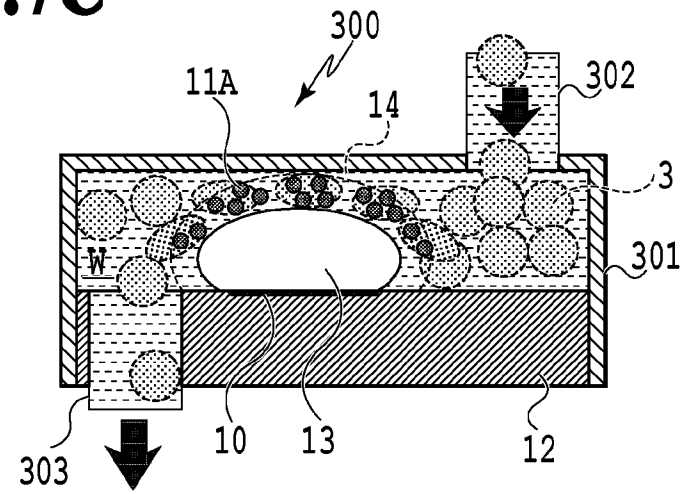

FIG. 7D illustrates the state where the film boiling bubble 13 has the maximum volume. As the film boiling bubble 13 is expanded by the inertia, the negative pressure inside the film boiling bubble 13 is gradually increased along with the expansion, and the negative pressure acts to shrink the film boiling bubble 13. At a time point when the negative pressure and the inertial force are balanced, the volume of the film boiling bubble 13 becomes the maximum, and then the shrinkage is started.

Figure 8A:
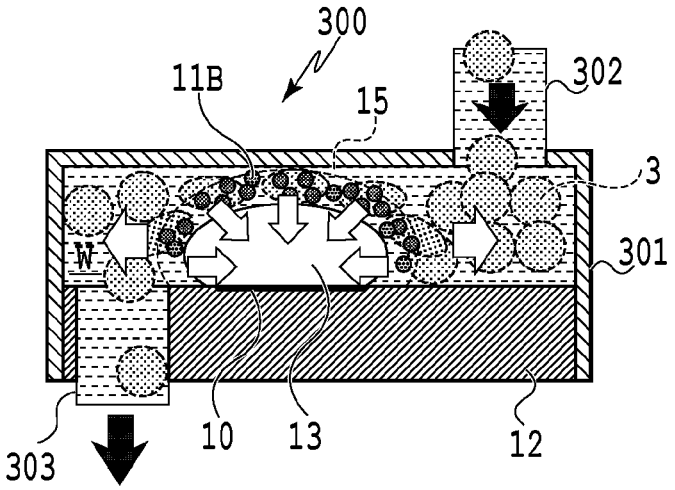
FIGS. 8A to 8C are diagrams illustrating the states of generation of UFBs caused by shrinkage of the film boiling bubble.
Figure 8B:
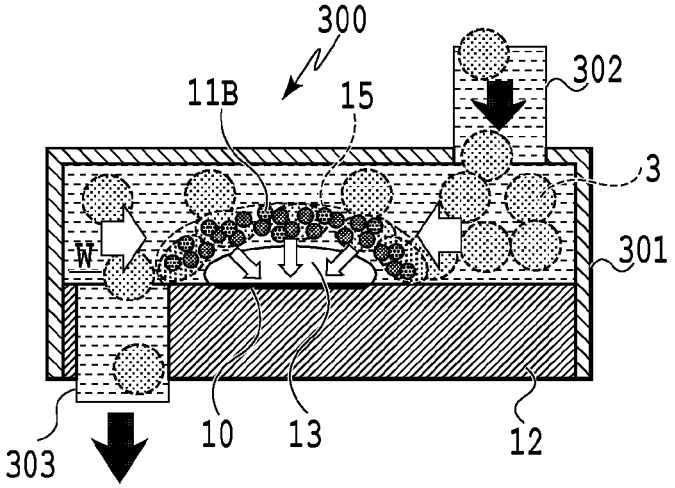
Figure 8C:
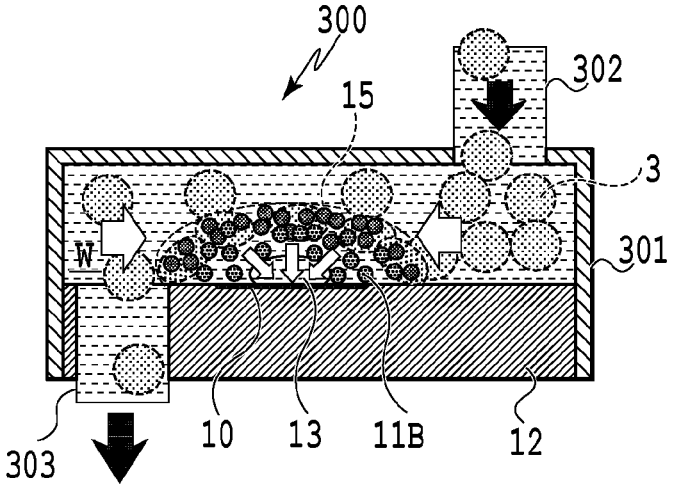
Figure 9A:
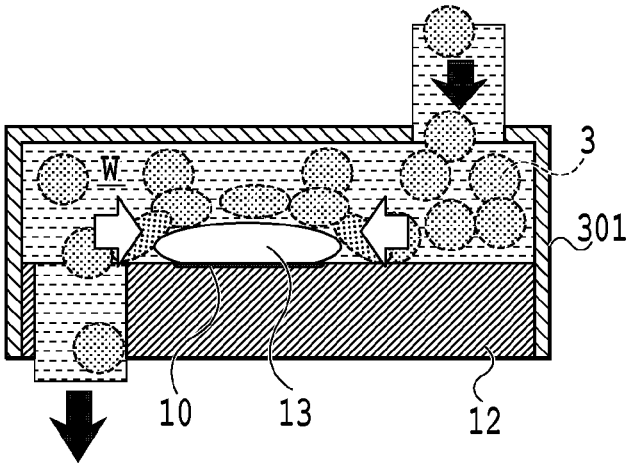
FIGS. 9A to 9C are diagrams illustrating the states of generation of UFBs caused by reheating of the liquid.
Figure 9B:
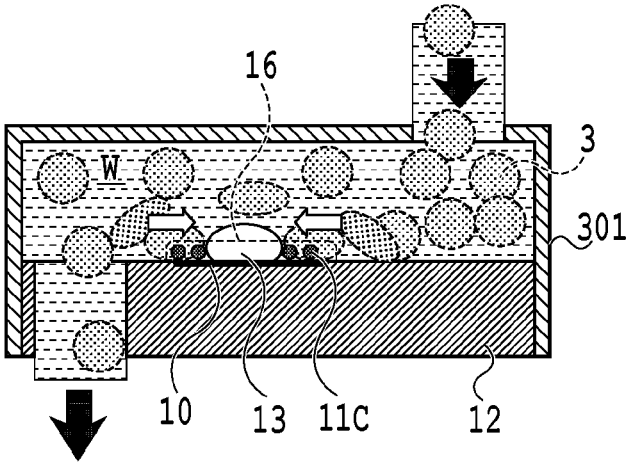
Figure 9C:
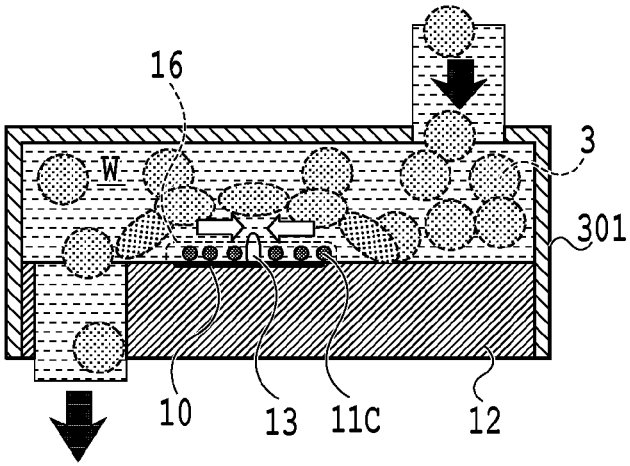

In the shrinking stage of the film boiling bubble 13, there are UFBs generated by the processes illustrated in FIGS. 8A to 8C (second UFBs 11B) and UFBs generated by the processes illustrated in FIGS. 9A to 9C (third UFBs 11C). It is considered that these two processes are made simultaneously.

FIGS. 8A to 8C are diagrams illustrating the states of generation of the UFBs 11 caused by the shrinkage of the film boiling bubble 13. FIG. 8A illustrates the state where the film boiling bubble 13 starts shrinking. Although the film boiling bubble 13 starts shrinking, the surrounding liquid W still has the inertial force in the expansion direction. Because of this, the inertial force acting in the direction of going away from the heating element 10 and the force going toward the heating element 10 caused by the shrinkage of the film boiling bubble 13 act in a surrounding region extremely close to the film boiling bubble 13, and the region is depressurized. The region is indicated in the drawings as a not-yet-bubbling negative pressure region 15.

The gas-dissolved liquid 3 within the not-yet-bubbling negative pressure region 15 exceeds the pressure dissolution limit and is vaporized to become an air bubble. The thus-vaporized air bubbles have diameters of about 100 nm and thereafter float independently in the liquid W without disappearing in a short time. In this embodiment, the air bubbles vaporized by the pressure action during the shrinkage of the film boiling bubble 13 are called the second UFBs 11B.

FIG. 8B illustrates a process of the shrinkage of the film boiling bubble 13. The shrinking speed of the film boiling bubble 13 is accelerated by the negative pressure, and the not-yet-bubbling negative pressure region 15 is also moved along with the shrinkage of the film boiling bubble 13. Specifically, in the process of the shrinkage of the film boiling bubble 13, the gas-dissolved liquids 3 within a part over the not-yet-bubbling negative pressure region 15 are precipitated one after another and become the second UFBs 11B.

FIG. 8C illustrates the state immediately before the disappearance of the film boiling bubble 13. Although the moving speed of the surrounding liquid W is also increased by the accelerated shrinkage of the film boiling bubble 13, a pressure loss occurs due to a flow passage resistance in the chamber 301. As a result, the region occupied by the not-yet-bubbling negative pressure region 15 is further increased, and a number of the second UFBs 11B are generated.

FIGS. 9A to 9C are diagrams illustrating the states of generation of the UFBs by reheating of the liquid W during the shrinkage of the film boiling bubble 13. FIG. 9A illustrates the state where the surface of the heating element 10 is covered with the shrinking film boiling bubble 13.

FIG. 9B illustrates the state where the shrinkage of the film boiling bubble 13 has progressed, and a part of the surface of the heating element 10 comes in contact with the liquid W. In this state, there is heat left on the surface of the heating element 10, but the heat is not high enough to cause the film boiling even if the liquid W comes in contact with the surface. A region of the liquid to be heated by coming in contact with the surface of the heating element 10 is indicated in the drawings as a not-yet-bubbling reheated region 16. Although the film boiling is not made, the gas-dissolved liquid 3 within the not-yet-bubbling reheated region 16 exceeds the thermal dissolution limit and is vaporized. In this embodiment, the air bubbles generated by the reheating of the liquid W during the shrinkage of the film boiling bubble 13 are called the third UFBs 11C.

FIG. 9C illustrates the state where the shrinkage of the film boiling bubble 13 has further progressed. The smaller the film boiling bubble 13, the greater the region of the heating element 10 in contact with the liquid W, and the third UFBs 11C are generated until the film boiling bubble 13 disappears.

Figure 10A:
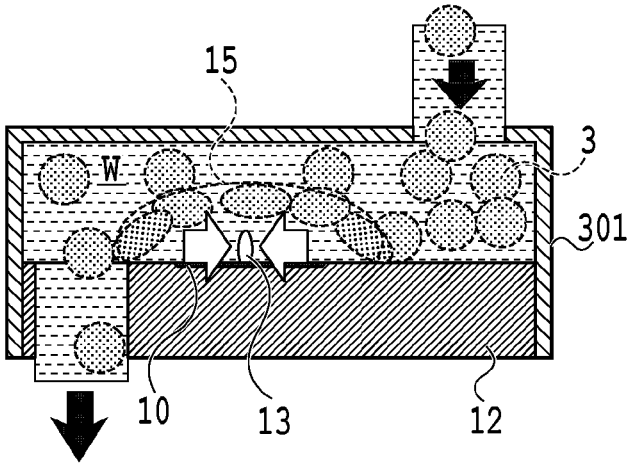
FIGS. 10A and 10B are diagrams illustrating the states of generation of UFBs caused by shock waves made by disappearance of the bubble generated by the film boiling.
Figure 10B:
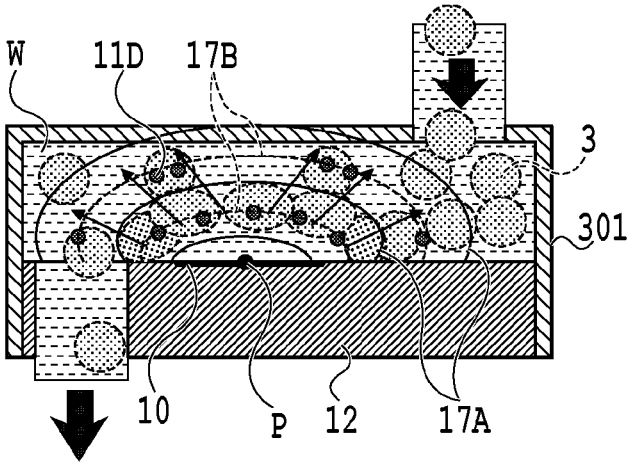

FIGS. 10A and 10B are diagrams illustrating the states of generation of the UFBs caused by an impact from the disappearance of the film boiling bubble 13 generated by the film boiling (that is, a type of cavitation). FIG. 10A illustrates the state immediately before the disappearance of the film boiling bubble 13. In this state, the film boiling bubble 13 shrinks rapidly by the internal negative pressure, and the not-yet-bubbling negative pressure region 15 surrounds the film boiling bubble 13.

FIG. 10B illustrates the state immediately after the film boiling bubble 13 disappears at a point P. When the film boiling bubble 13 disappears, acoustic waves ripple concentrically from the point P as a starting point due to the impact of the disappearance. The acoustic wave is a collective term of an elastic wave that is propagated through anything regardless of gas, liquid, and solid. In this embodiment, compression waves of the liquid W, which are a high pressure surface 17A and a low pressure surface 17B of the liquid W, are propagated alternately.

In this case, the gas-dissolved liquid 3 within the not-yet-bubbling negative pressure region 15 is resonated by the shock waves made by the disappearance of the film boiling bubble 13, and the gas-dissolved liquid 3 exceeds the pressure dissolution limit and the phase transition is made in timing when the low pressure surface 17B passes therethrough. Specifically, a number of air bubbles are vaporized in the not-yet-bubbling negative pressure region 15 simultaneously with the disappearance of the film boiling bubble 13. In this embodiment, the air bubbles generated by the shock waves made by the disappearance of the film boiling bubble 13 are called fourth UFBs 11D.

The fourth UFBs 11D generated by the shock waves made by the disappearance of the film boiling bubble 13 suddenly appear in an extremely short time (1 μS or less) in an extremely narrow thin film-shaped region. The diameter is sufficiently smaller than that of the first to third UFBs, and the gas-liquid interface energy is higher than that of the first to third UFBs. For this reason, it is considered that the fourth UFBs 11D have different characteristics from the first to third UFBs 11A to 11C and generate different effects.

Additionally, the fourth UFBs 11D are evenly generated in many parts of the region of the concentric sphere in which the shock waves are propagated, and the fourth UFBs 11D evenly exist in the chamber 301 from the generation thereof. Although many first to third UFBs already exist in the timing of the generation of the fourth UFBs 11D, the presence of the first to third UFBs does not affect the generation of the fourth UFBs 11D greatly. It is also considered that the first to third UFBs do not disappear due to the generation of the fourth UFBs 11D.

As described above, it is expected that the UFBs 11 are generated in the multiple stages from the generation to the disappearance of the film boiling bubble 13 by the heat generation of the heating element 10. The first UFBs 11A, the second UFBs 11B, and the third UFBs 11C are generated near the surface of the film boiling bubble generated by the film boiling. In this case, near means a region within about 20 μm from the surface of the film boiling bubble. The fourth UFBs 11D are generated in a region through which the shock waves are propagated when the air bubble disappears. Although the above example illustrates the stages to the disappearance of the film boiling bubble 13, the way of generating the UFBs is not limited thereto. For example, with the generated film boiling bubble 13 communicating with the atmospheric air before the bubble disappearance, the UFBs can be generated also if the film boiling bubble 13 does not reach the disappearance.

Next, remaining properties of the UFBs are described. The higher the temperature of the liquid, the lower the dissolution properties of the gas components, and the lower the temperature, the higher the dissolution properties of the gas components. In other words, the phase transition of the dissolved gas components is prompted and the generation of the UFBs becomes easier as the temperature of the liquid is higher. The temperature of the liquid and the solubility of the gas are in the inverse relationship, and the gas exceeding the saturation solubility is transformed into air bubbles and appeared in the liquid as the liquid temperature increases.

Therefore, when the temperature of the liquid rapidly increases from normal temperature, the dissolution properties are decreased without stopping, and the generation of the UFBs starts. The thermal dissolution properties are decreased as the temperature increases, and a number of the UFBs are generated.

Conversely, when the temperature of the liquid decreases from normal temperature, the dissolution properties of the gas are increased, and the generated UFBs are more likely to be liquefied. However, such temperature is sufficiently lower than normal temperature. Additionally, since the once generated UFBs have a high internal pressure and large gas-liquid interface energy even when the temperature of the liquid decreases, it is highly unlikely that there is exerted a sufficiently high pressure to break such a gas-liquid interface. In other words, the once generated UFBs do not disappear easily as long as the liquid is stored at normal temperature and normal pressure.

In this embodiment, the first UFBs 11A described with FIGS. 7A to 7C and the third UFBs 11C described with FIGS. 9A to 9C can be described as UFBs that are generated by utilizing such thermal dissolution properties of gas.

On the other hand, in the relationship between the pressure and the dissolution properties of liquid, the higher the pressure of the liquid, the higher the dissolution properties of the gas, and the lower the pressure, the lower the dissolution properties. In other words, the phase transition to the gas of the gas-dissolved liquid dissolved in the liquid is prompted and the generation of the UFBs becomes easier as the pressure of the liquid is lower. Once the pressure of the liquid becomes lower than normal pressure, the dissolution properties are decreased instantly, and the generation of the UFBs starts. The pressure dissolution properties are decreased as the pressure decreases, and a number of the UFBs are generated.

Conversely, when the pressure of the liquid increases to be higher than normal pressure, the dissolution properties of the gas are increased, and the generated UFBs are more likely to be liquefied. However, such pressure is sufficiently higher than the atmospheric pressure. Additionally, since the once generated UFBs have a high internal pressure and large gas-liquid interface energy even when the pressure of the liquid increases, it is highly unlikely that there is exerted a sufficiently high pressure to break such a gas-liquid interface. In other words, the once generated UFBs do not disappear easily as long as the liquid is stored at normal temperature and normal pressure.

In this embodiment, the second UFBs 11B described with FIGS. 8A to 8C and the fourth UFBs 11D described with FIGS. 10A to 10B can be described as UFBs that are generated by utilizing such pressure dissolution properties of gas.

Those first to fourth UFBs generated by different causes are described individually above; however, the above-described generation causes occur simultaneously with the event of the film boiling. Thus, at least two types of the first to the fourth UFBs may be generated at the same time, and these generation causes may cooperate to generate the UFBs. It should be noted that it is common for all the generation causes to be induced by the volume change of the film boiling bubble generated by the film boiling phenomenon. In this specification, the method of generating the UFBs by utilizing the film boiling caused by the rapid heating as described above is referred to as a thermal-ultrafine bubble (T-UFB) generating method. Additionally, the UFBs generated by the T-UFB generating method are referred to as T-UFBs, and the liquid containing the T-UFBs generated by the T-UFB generating method is referred to as a T-UFB-containing liquid.

Almost all the air bubbles generated by the T-UFB generating method are 1.0 μm or less, and milli-bubbles and microbubbles are unlikely to be generated. That is, the T-UFB generating method allows dominant and efficient generation of the UFBs. Additionally, the T-UFBs generated by the T-UFB generating method have larger gas-liquid interface energy than that of the UFBs generated by a conventional method, and the T-UFBs do not disappear easily as long as being stored at normal temperature and normal pressure. Moreover, even if new T-UFBs are generated by new film boiling, it is possible to prevent disappearance of the already generated T-UFBs due to the impact from the new generation. That is, it can be said that the number and the concentration of the T-UFBs contained in the T-UFB-containing liquid have the hysteresis properties depending on the number of times the film boiling is made in the T-UFB-containing liquid. In other words, it is possible to adjust the concentration of the T-UFBs contained in the T-UFB-containing liquid by controlling the number of the heating elements provided in the T-UFB generating unit 300 and the number of the voltage pulse application to the heating elements.

Reference to FIG. 1 is made again. Once the T-UFB-containing liquid W with a desired UFB concentration is generated in the T-UFB generating unit 300, the UFB-containing liquid W is supplied to the post-processing unit 400.

Figure 11A:
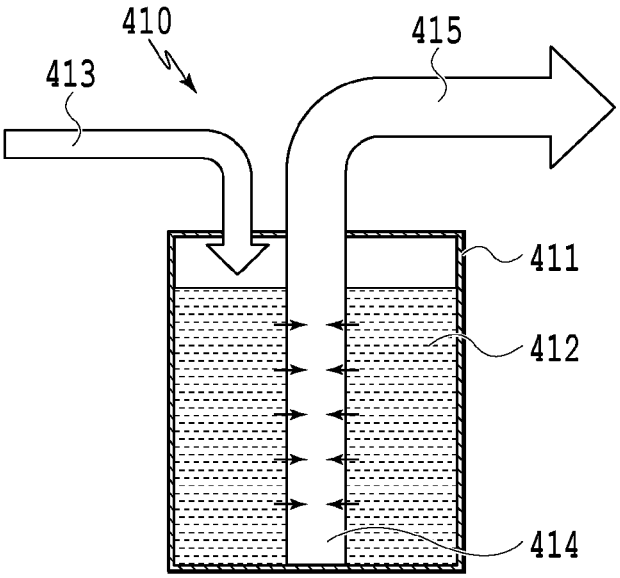
FIGS. 11A to 11C are diagrams illustrating a configuration example of a post-processing unit.
Figure 11B:
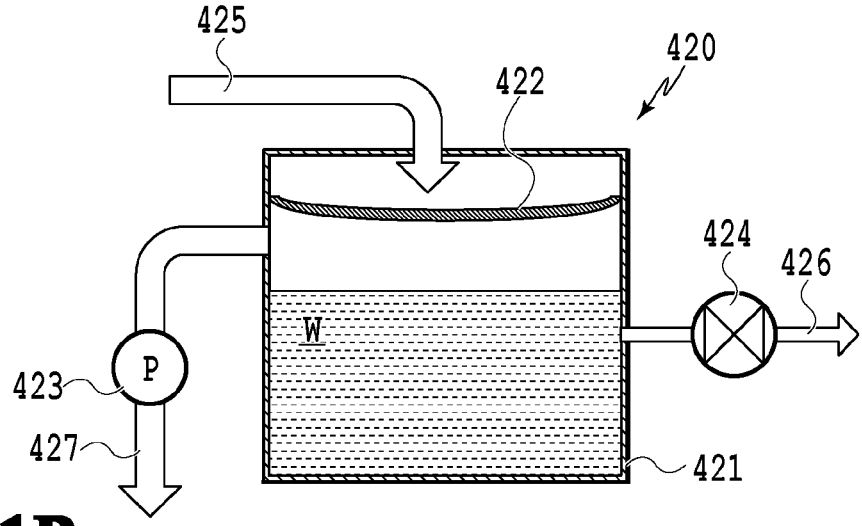
Figure 11C:
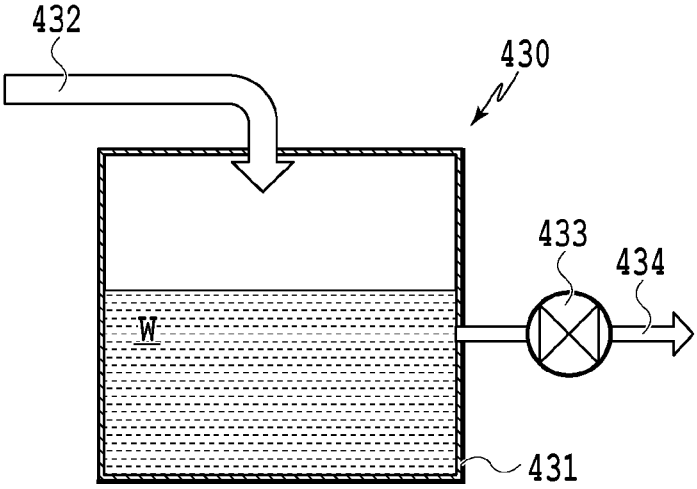

FIGS. 11A to 11C are diagrams illustrating configuration examples of the post-processing unit 400 of this embodiment. The post-processing unit 400 of this embodiment removes impurities in the UFB-containing liquid W in stages in the order from inorganic ions, organic substances, and insoluble solid substances.

FIG. 11A illustrates a first post-processing mechanism 410 that removes the inorganic ions. The first post-processing mechanism 410 includes an exchange container 411, cation exchange resins 412, a liquid introduction passage 413, a collecting pipe 414, and a liquid discharge passage 415. The exchange container 411 stores the cation exchange resins 412. The UFB-containing liquid W generated by the T-UFB generating unit 300 is injected to the exchange container 411 through the liquid introduction passage 413 and absorbed into the cation exchange resins 412 such that the cations as the impurities are removed. Such impurities include metal materials peeled off from the element substrate 12 of the T-UFB generating unit 300, such as $SiO_2$, SiN, SiC, Ta, $Al_2O_3$, $Ta_2O_5$, and Ir.

The cation exchange resins 412 are synthetic resins in which a functional group (ion exchange group) is introduced in a high polymer matrix having a three-dimensional network, and the appearance of the synthetic resins are spherical particles of around 0.4 to 0.7 mm. A general high polymer matrix is the styrene-divinylbenzene copolymer, and the functional group may be that of methacrylic acid series and acrylic acid series, for example. However, the above material is an example. As long as the material can remove desired inorganic ions effectively, the above material can be changed to various materials. The UFB-containing liquid W absorbed in the cation exchange resins 412 to remove the inorganic ions is collected by the collecting pipe 414 and transferred to the next step through the liquid discharge passage 415. In this process in the present embodiment, not all the inorganic ions contained in the UFB-containing liquid W supplied from the liquid introduction passage 413 need to be removed as long as at least a part of the inorganic ions are removed.

FIG. 11B illustrates a second post-processing mechanism 420 that removes the organic substances. The second post-processing mechanism 420 includes a storage container 421, a filtration filter 422, a vacuum pump 423, a valve 424, a liquid introduction passage 425, a liquid discharge passage 426, and an air suction passage 427. Inside of the storage container 421 is divided into upper and lower two regions by the filtration filter 422. The liquid introduction passage 425 is connected to the upper region of the upper and lower two regions, and the air suction passage 427 and the liquid discharge passage 426 are connected to the lower region thereof. Once the vacuum pump 423 is driven with the valve 424 closed, the air in the storage container 421 is discharged through the air suction passage 427 to make the pressure inside the storage container 421 negative pressure, and the UFB-containing liquid W is thereafter introduced from the liquid introduction passage 425. Then, the UFB-containing liquid W from which the impurities are removed by the filtration filter 422 is reserved into the storage container 421.

The impurities removed by the filtration filter 422 include organic materials that may be mixed at a tube or each unit, such as organic compounds including silicon, siloxane, and epoxy, for example. A filter film usable for the filtration filter 422 includes a filter of a sub-μm-mesh (a filter of 1 μm or smaller in mesh diameter) that can remove bacteria, and a filter of a nm-mesh that can remove virus. The filtration filter having such a fine opening diameter may remove air bubbles larger than the opening diameter of the filter. Particularly, there may be the case where the filter is clogged by the fine air bubbles adsorbed to the openings (mesh) of the filter, which may slowdown the filtering speed. However, as described above, most of the air bubbles generated by the T-UFB generating method described in the present embodiment of the invention are in the size of 1 μm or smaller in diameter, and milli-bubbles and microbubbles are not likely to be generated. That is, since the probability of generating milli-bubbles and microbubbles is extremely low, it is possible to suppress the slowdown in the filtering speed due to the adsorption of the air bubbles to the filter. For this reason, it is favorable to apply the filtration filter 422 provided with the filter of 1 μm or smaller in mesh diameter to the system having the T-UFB generating method.

Examples of the filtration applicable to this embodiment may be a so-called dead-end filtration and cross-flow filtration. In the dead-end filtration, the direction of the flow of the supplied liquid and the direction of the flow of the filtration liquid passing through the filter openings are the same, and specifically, the directions of the flows are made along with each other. In contrast, in the cross-flow filtration, the supplied liquid flows in a direction along a filter surface, and specifically, the direction of the flow of the supplied liquid and the direction of the flow of the filtration liquid passing through the filter openings are crossed with each other. It is preferable to apply the cross-flow filtration to suppress the adsorption of the air bubbles to the filter openings.

After a certain amount of the UFB-containing liquid W is reserved in the storage container 421, the vacuum pump 423 is stopped and the valve 424 is opened to transfer the T-UFB-containing liquid in the storage container 421 to the next step through the liquid discharge passage 426. Although the vacuum filtration method is employed as the method of removing the organic impurities herein, a gravity filtration method and a pressurized filtration can also be employed as the filtration method using a filter, for example.

FIG. 11C illustrates a third post-processing mechanism 430 that removes the insoluble solid substances. The third post-processing mechanism 430 includes a precipitation container 431, a liquid introduction passage 432, a valve 433, and a liquid discharge passage 434.

First, a predetermined amount of the UFB-containing liquid W is reserved into the precipitation container 431 through the liquid introduction passage 432 with the valve 433 closed, and leaving it for a while. Meanwhile, the solid substances in the UFB-containing liquid W are precipitated onto the bottom of the precipitation container 431 by gravity. Among the bubbles in the UFB-containing liquid, relatively large bubbles such as microbubbles are raised to the liquid surface by the buoyancy and also removed from the UFB-containing liquid. After a lapse of sufficient time, the valve 433 is opened, and the UFB-containing liquid W from which the solid substances and large bubbles are removed is transferred to the collecting unit 500 through the liquid discharge passage 434. The example of applying the three post-processing mechanisms in sequence is shown in this embodiment; however, it is not limited thereto, and the order of the three post-processing mechanisms may be changed, or at least one needed post-processing mechanism may be employed.

Reference to FIG. 1 is made again. The T-UFB-containing liquid W from which the impurities are removed by the post-processing unit 400 may be directly transferred to the collecting unit 500 or may be put back to the dissolving unit 200 again. In the latter case, the gas dissolution concentration of the T-UFB-containing liquid W that is decreased due to the generation of the T-UFBs can be compensated to the saturated state again by the dissolving unit 200. If new T-UFBs are generated by the T-UFB generating unit 300 after the compensation, it is possible to further increase the concentration of the UFBs contained in the T-UFB-containing liquid with the above-described properties. That is, it is possible to increase the concentration of the contained UFBs by the number of circulations through the dissolving unit 200, the T-UFB generating unit 300, and the post-processing unit 400, and it is possible to transfer the UFB-containing liquid W to the collecting unit 500 after a predetermined concentration of the contained UFBs is obtained. This embodiment shows a form in which the UFB-containing liquid processed by the post-processing unit 400 is put back to the dissolving unit 200 and circulated; however, it is not limited thereto, and the UFB-containing liquid after passing through the T-UFB generating unit may be put back again to the dissolving unit 200 before being supplied to the post-processing unit 400 such that the post-processing is performed by the post-processing unit 400 after the T-UFB concentration is increased through multiple times of circulation, for example.

The collecting unit 500 collects and preserves the UFB-containing liquid W transferred from the post-processing unit 400. The T-UFB-containing liquid collected by the collecting unit 500 is a UFB-containing liquid with high purity from which various impurities are removed.

In the collecting unit 500, the UFB-containing liquid W may be classified by the size of the T-UFBs by performing some stages of filtration processing. Since it is expected that the temperature of the T-UFB-containing liquid W obtained by the T-UFB method is higher than normal temperature, the collecting unit 500 may be provided with a cooling unit. The cooling unit may be provided to a part of the post-processing unit 400.

The schematic description of the UFB generating apparatus 1 is given above; however, it is needless to say that the illustrated multiple units can be changed, and not all of them need to be prepared. Depending on the type of the liquid W and the gas G to be used and the intended use of the T-UFB-containing liquid to be generated, a part of the above-described units may be omitted, or another unit other than the above-described units may be added.

For example, when the gas to be contained by the UFBs is the atmospheric air, the degassing unit as the pre-processing unit 100 and the dissolving unit 200 can be omitted. On the other hand, when multiple kinds of gases are desired to be contained by the UFBs, another dissolving unit 200 may be added.

The units for removing the impurities as described in FIGS. 11A to 11C may be provided upstream of the T-UFB generating unit 300 or may be provided both upstream and downstream thereof. When the liquid to be supplied to the UFB generating apparatus is tap water, rain water, contaminated water, or the like, there may be included organic and inorganic impurities in the liquid. If such a liquid W including the impurities is supplied to the T-UFB generating unit 300, there is a risk of deteriorating the heating element 10 and inducing the salting-out phenomenon. With the mechanisms as illustrated in FIGS. 11A to 11C provided upstream of the T-UFB generating unit 300, it is possible to remove the above-described impurities previously.

Note that in the above description, a control apparatus is included which controls actuator parts of the above-described units, including their opening-closing valves and pumps, and the control apparatus is used to perform UFB generation control according to the user's settings. The UFB generation control by this control apparatus will be described in the embodiments to be discussed later.

<<Liquid and Gas Usable for T-UFB-Containing Liquid>>

Now, the liquid W usable for generating the T-UFB-containing liquid is described. The liquid W usable in this embodiment is, for example, pure water, ion exchange water, distilled water, bioactive water, magnetic active water, lotion, tap water, sea water, river water, clean and sewage water, lake water, underground water, rain water, and so on. A mixed liquid containing the above liquid and the like is also usable. A mixed solvent containing water and soluble organic solvent can be also used. The soluble organic solvent to be used by being mixed with water is not particularly limited; however, the followings can be a specific example thereof. An alkyl alcohol group of the carbon number of 1 to 4 including methyl alcohol, ethyl alcohol, n-propyl alcohol, isopropyl alcohol, n-butyl alcohol, sec-butyl alcohol, and tert-butyl alcohol. An amide group including N-methyl-2-pyrrolidone, 2-pyrrolidone, 1,3-dimethyl-2-imidazolidinone, N,N-dimethylformamide, and N,N-dimethylacetamide. A ketone group or a ketoalcohol group including acetone and diacetone alcohol. A cyclic ether group including tetrahydrofuran and dioxane. A glycol group including ethylene glycol, 1,2-propylene glycol, 1,3-propylene glycol, 1,2-butanediol, 1,3-butanediol, 1,4-butanediol, 1,5-pentanediol, 1,2-hexanediol, 1,6-hexanediol, 3-methyl-1,5-pentanediol, diethylene glycol, triethylene glycol, and thiodiglycol. A group of lower alkyl ether of polyhydric alcohol including ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, triethylene glycol monomethyl ether, triethylene glycol monoethyl ether, and triethylene glycol monobutyl ether. A polyalkylene glycol group including polyethylene glycol and polypropylene glycol. A triol group including glycerin, 1,2,6-hexanetriol, and trimethylolpropane. These soluble organic solvents can be used individually, or two or more of them can be used together.

A gas component that can be introduced into the dissolving unit 200 is, for example, hydrogen, helium, oxygen, nitrogen, methane, fluorine, neon, carbon dioxide, ozone, argon, chlorine, ethane, propane, air, and so on. The gas component may be a mixed gas containing some of the above. Additionally, it is not necessary for the dissolving unit 200 to dissolve a substance in a gas state, and the dissolving unit 200 may fuse a liquid or a solid containing desired components into the liquid W. The dissolution in this case may be spontaneous dissolution, dissolution caused by pressure application, or dissolution caused by hydration, ionization, and chemical reaction due to electrolytic dissociation.

<<Effects of T-UFB Generating Method>>

Next, the characteristics and the effects of the above-described T-UFB generating method are described by comparing with a conventional UFB generating method. For example, in a conventional air bubble generating apparatus as represented by the Venturi method, a mechanical depressurizing structure such as a depressurizing nozzle is provided in a part of a flow passage. A liquid flows at a predetermined pressure to pass through the depressurizing structure, and air bubbles of various sizes are generated in a downstream region of the depressurizing structure.

In this case, among the generated air bubbles, since the relatively large bubbles such as milli-bubbles and microbubbles are affected by the buoyancy, such bubbles rise to the liquid surface and disappear. Even the UFBs that are not affected by the buoyancy may also disappear with the milli-bubbles and microbubbles since the gas-liquid interface energy of the UFBs is not very large. Additionally, even if the above-described depressurizing structures are arranged in series, and the same liquid flows through the depressurizing structures repeatedly, it is impossible to store for a long time the UFBs of the number corresponding to the number of repetitions. In other words, it has been difficult for the UFB-containing liquid generated by the conventional UFB generating method to maintain the concentration of the contained UFBs at a predetermined value for a long time.

In contrast, in the T-UFB generating method of this embodiment utilizing the film boiling, a rapid temperature change from normal temperature to about 300° C. and a rapid pressure change from normal pressure to around a several megapascal occur locally in a part extremely close to the heating element. The heating element is a rectangular shape having one side of around several tens to hundreds of μm. It is around 1/10 to 1/1000 of the size of a conventional UFB generating unit. Additionally, with the gas-dissolved liquid within the extremely thin film region of the film boiling bubble surface exceeding the thermal dissolution limit or the pressure dissolution limit instantaneously (in an extremely short time under microseconds), the phase transition occurs and the gas-dissolved liquid is precipitated as the UFBs. In this case, the relatively large bubbles such as milli-bubbles and microbubbles are hardly generated, and the liquid contains the UFBs of about 100 nm in diameter with extremely high purity. Moreover, since the T-UFBs generated in this way have sufficiently large gas-liquid interface energy, the T-UFBs are not broken easily under the normal environment and can be stored for a long time.

Particularly, the present invention using the film boiling phenomenon that enables local formation of a gas interface in the liquid can form an interface in a part of the liquid close to the heating element without affecting the entire liquid region, and a region on which the thermal and pressure actions performed can be extremely local. As a result, it is possible to stably generate desired UFBs. With further more conditions for generating the UFBs applied to the generation liquid through the liquid circulation, it is possible to additionally generate new UFBs with small effects on the already-made UFBs. As a result, it is possible to produce a UFB-containing liquid of a desired size and concentration relatively easily.

Moreover, since the T-UFB generating method has the above-described hysteresis properties, it is possible to increase the concentration to a desired concentration while keeping the high purity. In other words, according to the T-UFB generating method, it is possible to efficiently generate a long-time storable UFB-containing liquid with high purity and high concentration.

<<Specific Usage of T-UFB-Containing Liquid>>

In general, applications of the ultrafine bubble-containing liquids are distinguished by the type of the containing gas. Any type of gas can make the UFBs as long as an amount of around PPM to BPM of the gas can be dissolved in the liquid. For example, the ultrafine bubble-containing liquids can be applied to the following applications.

- A UFB-containing liquid containing air can be preferably applied to cleansing in the industrial, agricultural and fishery, and medical scenes and the like, and to cultivation of plants and agricultural and fishery products.
- A UFB-containing liquid containing ozone can be preferably applied to not only cleansing application in the industrial, agricultural and fishery, and medical scenes and the like, but to also applications intended to disinfection, sterilization, and decontamination, and environmental cleanup of drainage and contaminated soil, for example.
- A UFB-containing liquid containing nitrogen can be preferably applied to not only cleansing application in the industrial, agricultural and fishery, and medical scenes and the like, but to also applications intended to disinfection, sterilization, and decontamination, and environmental cleanup of drainage and contaminated soil, for example.
- A UFB-containing liquid containing oxygen can be preferably applied to cleansing application in the industrial, agricultural and fishery, and medical scenes and the like, and to cultivation of plants and agricultural and fishery products.
- A UFB-containing liquid containing carbon dioxide can be preferably applied to not only cleansing application in the industrial, agricultural and fishery, and medical scenes and the like, but to also applications intended to disinfection, sterilization, and decontamination, for example.
- A UFB-containing liquid containing perfluorocarbons as a medical gas can be preferably applied to ultrasonic diagnosis and treatment. As described above, the UFB-containing liquids can exert the effects in various fields of medical, chemical, dental, food, industrial, agricultural and fishery, and so on.

In each of the applications, the purity and the concentration of the UFBs contained in the UFB-containing liquid are important for quickly and reliably exert the effect of the UFB-containing liquid. In other words, unprecedented effects can be expected in various fields by utilizing the T-UFB generating method of this embodiment that enables generation of the UFB-containing liquid with high purity and desired concentration. Here is below a list of the applications in which the T-UFB generating method and the T-UFB-containing liquid are expected to be preferably applicable.

(A) Liquid Purification Application

- With the T-UFB generating unit provided to a water clarification unit, enhancement of an effect of water clarification and an effect of purification of PH adjustment liquid is expected. The T-UFB generating unit may also be provided to a carbonated water server.
- With the T-UFB generating unit provided to a humidifier, aroma diffuser, coffee maker, and the like, enhancement of a humidifying effect, a deodorant effect, and a scent spreading effect in a room is expected.
- If the UFB-containing liquid in which an ozone gas is dissolved by the dissolving unit is generated and is used for dental treatment, burn treatment, and wound treatment using an endoscope, enhancement of a medical cleansing effect and an antiseptic effect is expected.
- With the T-UFB generating unit provided to a water storage tank of a condominium, enhancement of a water clarification effect and chlorine removing effect of drinking water to be stored for a long time is expected.
- If the T-UFB-containing liquid containing ozone or carbon dioxide is used for brewing process of Japanese sake, shochu, wine, and so on in which the high-temperature pasteurization processing cannot be performed, more efficient pasteurization processing than that with the conventional liquid is expected.
- If the UFB-containing liquid is mixed into the ingredient in a production process of the foods for specified health use and the foods with functional claims, the pasteurization processing is possible, and thus it is possible to provide safe and functional foods without a loss of flavor.
- With the T-UFB generating unit provided to a supplying route of sea water and fresh water for cultivation in a cultivation place of fishery products such as fish and pearl, prompting of spawning and growing of the fishery products is expected.
- With the T-UFB generating unit provided in a purification process of water for food preservation, enhancement of the preservation state of the food is expected.

With the T-UFB generating unit provided in a bleaching unit for bleaching pool water or underground water, a higher bleaching effect is expected.

With the T-UFB-containing liquid used for repairing a crack of a concrete member, enhancement of the effect of crack repairment is expected.

With the T-UFBs contained in liquid fuel for a machine using liquid fuel (such as automobile, vessel, and airplane), enhancement of energy efficiency of the fuel is expected.

(B) Cleansing Application

Recently, the UFB-containing liquids have been receiving attention as cleansing water for removing soils and the like attached to clothing. If the T-UFB generating unit described in the above embodiment is provided to a washing machine, and the UFB-containing liquid with higher purity and better permeability than the conventional liquid is supplied to the washing tub, further enhancement of detergency is expected.

With the T-UFB generating unit provided to a bath shower and a bedpan washer, not only a cleansing effect on all kinds of animals including human body but also an effect of prompting contamination removal of a water stain and a mold on a bathroom and a bedpan are expected.

With the T-UFB generating unit provided to a window washer for automobiles, a high-pressure washer for cleansing wall members and the like, a car washer, a dishwasher, a food washer, and the like, further enhancement of the cleansing effects thereof is expected.

With the T-UFB-containing liquid used for cleansing and maintenance of parts produced in a factory including a burring step after pressing, enhancement of the cleansing effect is expected.

In production of semiconductor elements, if the T-UFB-containing liquid is used as polishing water for a wafer, enhancement of the polishing effect is expected. Additionally, if the T-UFB-containing liquid is used in a resist removal step, prompting of peeling of resist that is not peeled off easily is enhanced.

With the T-UFB generating unit is provided to machines for cleansing and decontaminating medical machines such as a medical robot, a dental treatment unit, an organ preservation container, and the like, enhancement of the cleansing effect and the decontamination effect of the machines is expected. The T-UFB generating unit is also applicable to treatment of animals.

(C) Pharmaceutical Application

If the T-UFB-containing liquid is contained in cosmetics and the like, permeation into subcutaneous cells is prompted, and additives that give bad effects to skin such as preservative and surfactant can be reduced greatly. As a result, it is possible to provide safer and more functional cosmetics.

If a high concentration nanobubble preparation containing the T-UFBs is used for contrasts for medical examination apparatuses such as a CT and an MRI, reflected light of X-rays and ultrasonic waves can be efficiently used. This makes it possible to capture a more detailed image that is usable for initial diagnosis of a cancer and the like.

If a high concentration nanobubble water containing the T-UFBs is used for a ultrasonic wave treatment machine called high-intensity focused ultrasound (HIFU), the irradiation power of ultrasonic waves can be reduced, and thus the treatment can be made more non-invasive. Particularly, it is possible to reduce the damage to normal tissues.

It is possible to create a nanobubble preparation by using high concentration nanobubbles containing the T-UFBs as a source, modifying a phospholipid forming a liposome in a negative electric charge region around the air bubble, and applying various medical substances (such as DNA and RNA) through the phospholipid.

If a drug containing high concentration nanobubble water made by the T-UFB generation is transferred into a dental canal for regenerative treatment of pulp and dentine, the drug enters deeply a dentinal tubule by the permeation effect of the nanobubble water, and the decontamination effect is prompted. This makes it possible to treat the infected root canal of the pulp safely in a short time.

First Embodiment

Next, a first embodiment of the present invention will be described. A UFB-containing liquid producing apparatus in the present embodiment has a configuration capable of continuing supplying a UFB-containing liquid even in a case where one of its constituent elements falls into a malfunctioning state. It is therefore possible to solve the problem with conventional apparatuses in that the supply of a UFB-containing liquid is intermitted due to a process of replacing a broken element or the like. In the following, in order to clarify the effectiveness of the present embodiment, a schematic configuration of a conventional apparatus will be described first, and a configuration and operation of the present embodiment will be described thereafter.

Figure 21:
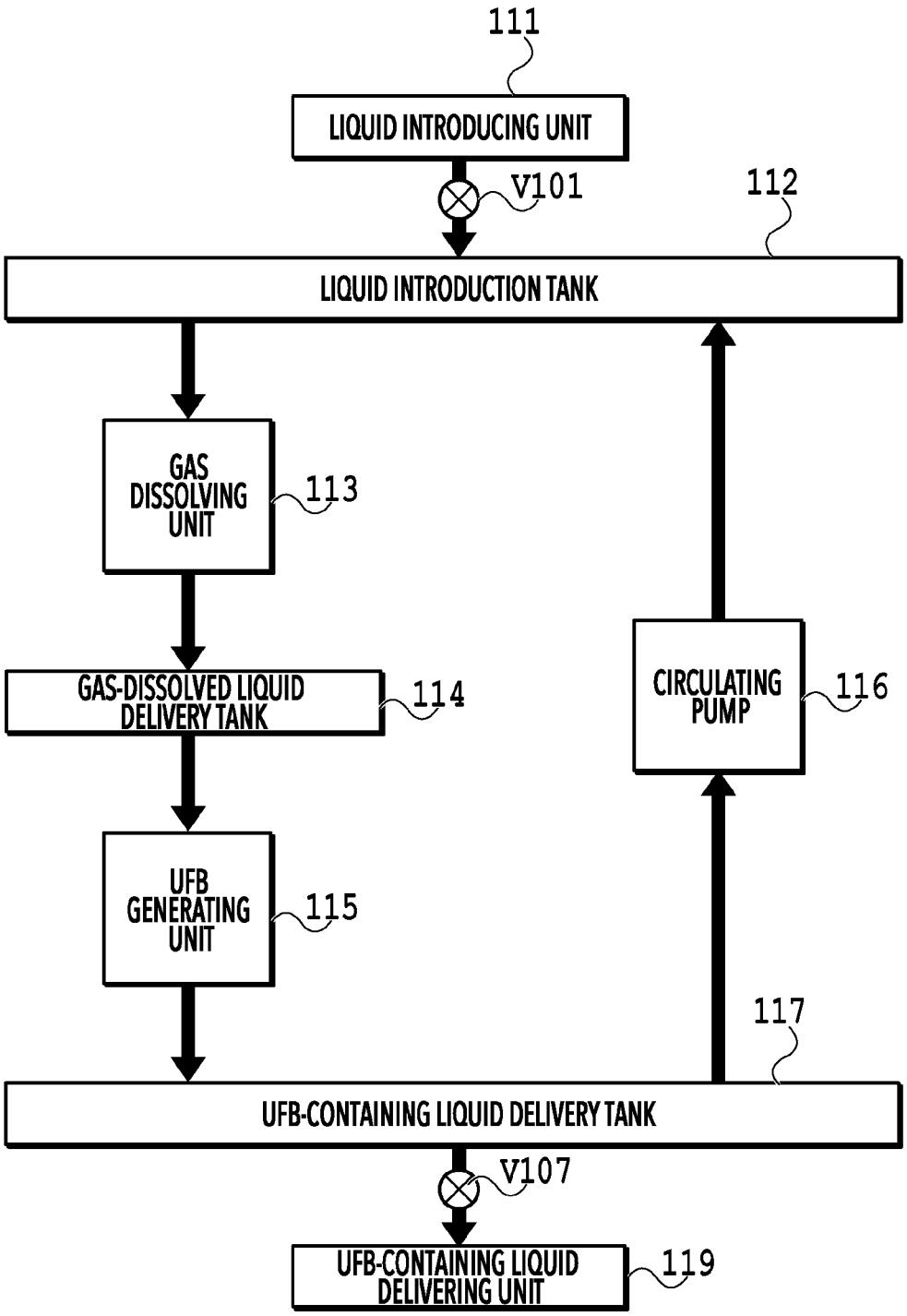
FIG. 21 is a block diagram illustrating a configuration of a conventional UFB-containing liquid producing apparatus.

FIG. 21 is a diagram illustrating a schematic configuration of a conventional UFB-containing liquid producing apparatus. A liquid introducing unit 111 supplies a liquid (e.g., water) in which to generate UFBs into a liquid introduction tank 112 through an opening-closing valve V111. The liquid introduction tank 112 is supplied with the liquid supplied from the liquid introducing unit 111, in which UFBs are yet to be generated, and a UFB-containing liquid supplied from a circulating pump 116, in which UFBs have been generated, and supplies a liquid in which both of these liquids are mixed to a gas dissolving unit 113.

The gas dissolving unit 113 dissolves a gas into the liquid supplied from the liquid introduction tank 112 to produce a gas-dissolved liquid and supplies it to a gas-dissolved liquid delivery tank 114. A method such as a pressurized dissolution method or bubbling is used as a method of dissolving the gas. The gas-dissolved liquid delivery tank 114 serves to receive the gas-dissolved liquid supplied from the gas dissolving unit 103 and supply it to a UFB generating unit 115.

The UFB generating unit 115 generates UFBs in the gas-dissolved liquid supplied from the gas-dissolved liquid delivery tank 114 to produce a UFB-containing liquid, and supplies the produced UFB-containing liquid to a UFB-containing liquid delivery tank 117. The UFB-containing liquid delivery tank 117 serves to receive the UFB-containing liquid supplied from the UFB generating unit 115, and supply the UFB-containing liquid to the circulating pump 116 or a UFB-containing liquid delivering unit 119.

The circulating pump 116 serves to suck the UFB-containing liquid from the UFB-containing liquid delivery tank 117 and supply it to the liquid introduction tank 112. This circulating pump 116 enables liquid circulation through a circulation route of the liquid introduction tank 112→the gas dissolving unit 113→the gas-dissolved liquid delivery tank 114→the UFB generating unit 115→the UFB-containing liquid delivery tank 117→the circulating pump 116→the liquid introduction tank 112. By performing liquid circulation in this manner, it is possible to produce a UFB-containing liquid in which UFBs are present at a desired density. The produced UFB-containing liquid is delivered to the UFB-containing liquid delivering unit 119 through an opening-closing valve V117. The UFB-containing liquid delivering unit 119 supplies the UFB-containing liquid to any of various UFB using apparatuses such as a cleaning apparatus or a medical apparatus.

The liquid changes as below while circulating through the circulation route.

- As the gas dissolved at the gas dissolving unit 113 is turned into UFBs at the UFB generating unit 115, the amount of the dissolved gas in the liquid decreases (note that the total gas amount, or the amount of the dissolved gas+the amount of the gas in the UFBs, remains substantially unchanged).
- The liquid in which the amount of the dissolved gas has decreased passes through the circulation route to flow into the gas dissolving unit 103 again, so that the amount of the dissolved gas increases. Accordingly, the total gas amount (the amount of the dissolved gas+the amount of the gas in the UFBs) increases.
- The amount of the dissolved gas saturates at a certain value determined by temperature and gas type, but a stable gas-containing liquid is produced in which the total gas amount (the amount of the dissolved gas+the amount of the gas in the UFBs) is greater than the saturated dissolved gas amount.

Meanwhile, an opening-closing valve V111 is provided between the liquid introducing unit 111 and the liquid introduction tank 112, and the opening-closing valve V117 is provided between the UFB-containing liquid delivery tank 117 and the UFB-containing liquid delivering unit 119. Both of the opening-closing valves V111 and V117 are in an open state (communicating state) during production of a UFB-containing. In a case of replacing any of the gas dissolving unit 113, the UFB generating unit 115, and the circulating pump 116, the replacement process is performed with the opening-closing valves V111 and V117 set in a closed state (shut-off state). After the replacement process is completed, the opening-closing valves V111 and V117 are set into an open state, and the production of a UFB-containing liquid is resumed.

As described above, a single circulation route is formed in the conventional UFB-containing liquid producing apparatus. The circulation route includes constituent elements such as the gas dissolving unit 113, the UFB generating unit 115, and the circulating pump 106, and there is a possibility that they malfunction. In a case where one of the constituent elements in the circulation route malfunctions, it will be necessary to perform a process such as replacement or repair of the constituent element. In this case, the production of a UFB-containing liquid will be stopped and the supply of a UFB-containing liquid to the UFB-containing liquid delivering unit 119 will be shut off until the process is completed.

For this reason, in a case where a UFB using apparatus (not illustrated) connected to the UFB-containing liquid delivering unit 119 requires a constant supply of a UFB-containing liquid at all times, there is a possibility of falling into a situation where the operation of the UFB using apparatus has to be stopped if the UFB-containing liquid producing apparatus stops. Thus, in the case of a UFB using apparatus used in a situation where it is required to operate continuously, such as a medical apparatus or a plant, stoppage of the UFB-containing liquid producing apparatus has a tremendous impact on the UFB using apparatus. The present embodiment can solve the problem with a conventional apparatus as above, and has a configuration capable of continuing supplying a UFB-containing liquid even in a case where an element in the apparatus malfunctions.

Figure 12:
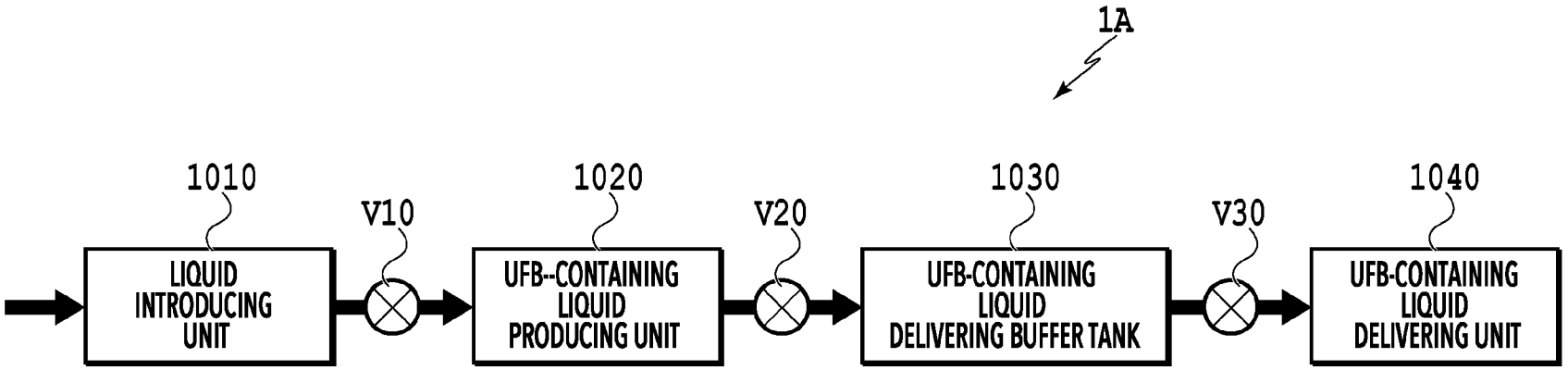
FIG. 12 is a block diagram schematically illustrating a configuration of a UFB-containing liquid producing apparatus in a first embodiment.

FIG. 12 is a block diagram schematically illustrating the configuration of the present embodiment. A UFB-containing liquid producing apparatus 1A illustrated in FIG. 12 has a liquid introducing unit 1010, a UFB-containing liquid producing unit 1020, a UFB-containing liquid delivering buffer tank (hereinafter referred to as the buffer tank) 1030, and a UFB-containing liquid delivering unit (liquid delivering unit) 1040.

The UFB-containing liquid producing unit 1020 is connected to the liquid introducing unit 1010 via an opening-closing valve V10. Further, the UFB-containing liquid producing unit 1020 (producing unit) is connected to the UFB-containing liquid delivering buffer tank 1030 via an opening-closing valve V20. The UFB-containing liquid delivering buffer tank 1030 is connected to the UFB-containing liquid delivering unit 1040 via an opening-closing valve V30.

Figure 13:
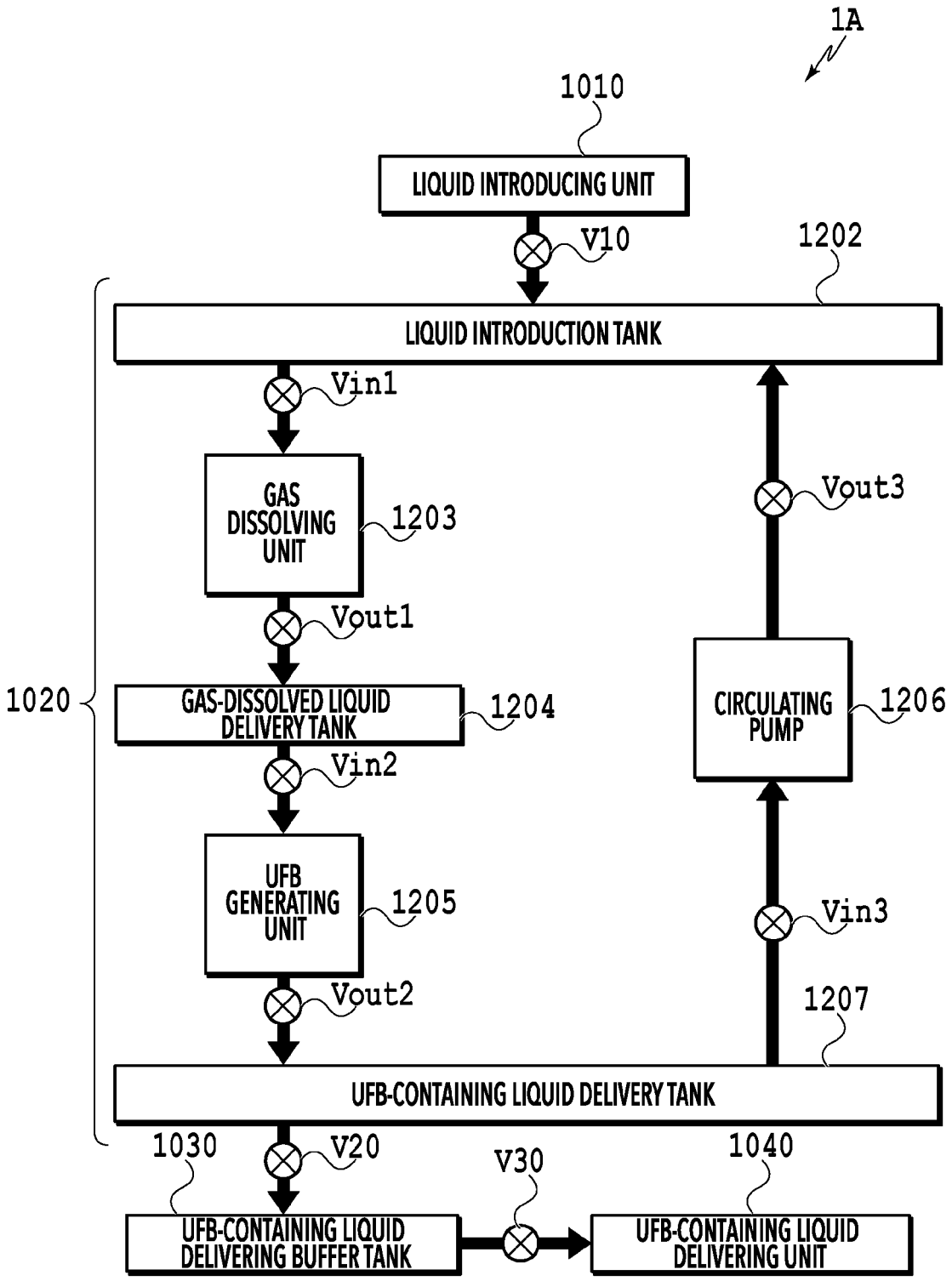
FIG. 13 is a block diagram illustrating the configuration of the UFB-containing liquid producing apparatus illustrated in FIG. 12 in more detail.

FIG. 13 is a block diagram illustrating the configuration of the UFB-containing liquid producing apparatus 1A illustrated in FIG. 12 in more detail. The UFB-containing liquid producing apparatus 1A is provided with the liquid introducing unit 1010, the UFB-containing liquid producing unit 1020, the buffer tank 1030, and the UFB-containing liquid delivering unit 1040, as mentioned above. The UFB-containing liquid producing unit 1020 is configured of a liquid introduction tank 1202, a gas dissolving unit 1203, a gas-dissolved liquid delivery tank 1204, a UFB generating unit 1205, a UFB-containing liquid delivery tank 1207, and a circulating pump 1206.

The UFB-containing liquid producing unit 1020 has a configuration capable of circulating a liquid supplied from the liquid introducing unit 1010 and producing a UFB-containing liquid of a desired concentration. The UFB-containing liquid produced by the UFB-containing liquid producing unit 1020 is accumulated into the buffer tank 1030 through the opening-closing valve V20 and then supplied to the UFB-containing liquid delivering unit 1040 through the opening-closing valve V30. The UFB-containing liquid supplied to the UFB-containing liquid delivering unit 1040 is supplied to a UFB using apparatus (not illustrated). Examples of the UFB using apparatus may include various apparatuses including a cleaning apparatus, a medical apparatus, and so on, as mentioned in the above description of the basic configuration.

Also, six opening-closing valves are provided between the above constituent elements. Specifically, an opening-closing valve Vin1 is provided between the liquid introduction tank 1202 and the gas dissolving unit 1203, and an opening-closing valve Vout1 is provided between the gas dissolving unit 1203 and the gas-dissolved liquid delivery tank 1204. Also, an opening-closing valve Vin2 is provided between the gas-dissolved liquid delivery tank 1204 and the UFB generating unit 1205, and an opening-closing valve Vout2 is provided between the UFB generating unit 1205 and the UFB-containing liquid delivery tank 1207. Further, an opening-closing valve Vin3 is provided between the UFB-containing liquid delivery tank 1207 and the circulating pump 1206, and an opening-closing valve Vout3 is provided between the circulating pump 1206 and the liquid introduction tank 1202. These valves are set in a closed state during replacement of the respective constituent elements.

After the replacement process is finished, the valves are set into an open state and the new constituent elements are caused to operate again.

Also, the opening-closing valve V10 is provided between the liquid introducing unit 1010 and the liquid introduction tank 1202, and the opening-closing valve V20 is provided between the UFB-containing liquid delivery tank 1207 and the buffer tank 1030. Further, the opening-closing valve V30 is provided between the buffer tank 1030 and the UFB-containing liquid delivering unit 1040. In a case of installing the gas dissolving unit 1203, the UFB generating unit 1205, and the circulating pump 1206 at the time of arrival or the like, the opening-closing valves V10 and V20 are set into a closed state to be in a state of shutting off a liquid flow. Then, in a state where the installation process after the arrival is completed, the opening-closing valve V10 and the opening-closing valve V20 are set into an open state, and production of a UFB-containing liquid is started.

The functions of the above elements will now be described. The liquid introducing unit 1010 supplies a liquid (e.g., water) in which to generate UFBs into the liquid introduction tank 1202 through the opening-closing valve V10. The liquid introduction tank 1202 receives the liquid supplied from the liquid introducing unit 1010 and a UFB-containing liquid supplied from the circulating pump 1206. Also, the liquid introduction tank 1202 serves to supply a mixed liquid of the liquid supplied from the liquid introducing unit 1010 and the UFB-containing liquid supplied from the circulating pump 1206 to the gas dissolving unit 1203 through the opening-closing valve Vin1.

The gas dissolving unit 1203 dissolves a gas into the liquid supplied from the liquid introduction tank 1202 to produce a gas-dissolved liquid, and supplies the produced gas-dissolved liquid to the gas-dissolved liquid delivery tank 1204 through the opening-closing valve Vout1. Note that a method such as a pressurized dissolution method or bubbling is used as a method of dissolving the gas into the liquid.

The gas-dissolved liquid delivery tank 1204 receives the gas-dissolved liquid supplied from the gas dissolving unit 1203 and supplies the received gas-dissolved liquid to the UFB generating unit 1205 through the opening-closing valve Vin2.

The UFB generating unit 1205 generates UFBs in the gas-dissolved liquid supplied from the gas-dissolved liquid delivery tank 1204. In the present embodiment, UFBs are generated in the supplied gas-dissolved liquid by a T-UFB method using a heater, like the above-described basic configuration. The UFB-containing liquid containing the UFBs is transferred to the UFB-containing liquid delivery tank 1207.

The UFB-containing liquid delivery tank 1207 serves to receive the UFB-containing liquid supplied from the UFB generating unit 1205, and supply it to the circulating pump 1206 and the buffer tank 1030. The circulating pump 1206 receives the UFB-containing liquid supplied from the UFB-containing liquid delivery tank 1207 and supplies it to the liquid introduction tank 1202.

Note that the configurations of the units illustrated in the above-described basic configuration can be employed for the above constituent elements. Specifically, the configuration of the pre-processing unit 100 illustrated in the basic configuration can be employed for the liquid introduction tank 1202. The configuration of the dissolving unit 200 illustrated in the basic configuration can be employed for the gas dissolving unit 1203 and the gas-dissolved liquid delivery tank 1204. The configuration of the T-UFB generating unit 300 illustrated in the basic configuration can be employed for the UFB generating unit 1205. The configuration of the post-processing unit 400 illustrated in the basic configuration can be employed for the UFB-containing liquid delivery tank 1207. Further, the collecting unit 500 illustrated in the basic configuration can be employed as the UFB-containing liquid delivering unit 1040.

The buffer tank 1030 serves to receive and accumulate a UFB-containing liquid provided from the UFB-containing liquid delivery tank 1207 and supply a certain amount of the UFB-containing liquid to the UFB-containing liquid delivering unit 1040 to be described later. In a case of delivering a UFB-containing liquid to and accumulating it in the buffer tank 1030, the valve V10 and the valve V20 are set into an open state, i.e., a state where the UFB-containing liquid can flow.

Also, in a case of raising the UFB concentration of the UFB-containing liquid, the valve V10 and the valve V20 are set into a closed state. Similarly, in a case of replacing any of the gas dissolving unit 1203, the UFB generating unit 1205, and the circulating pump 1206, the replacement process is performed with the valves V10, V20, Vin1, Vout1, Vin2, Vout2, Vin3, and Vout3 set in a closed state.

The valve V30 provided between the buffer tank 1030 and the UFB-containing liquid delivering unit 1040 is set into an open state in a case of producing a UFB-containing liquid, and is set into a closed state in a case of finishing the production of a UFB-containing liquid.

In a case where the rate of delivery of a UFB-containing liquid to the buffer tank>the rate of delivery of a UFB-containing liquid to the UFB-containing liquid delivering unit, an excess UFB-containing liquid corresponding to (the rate of delivery of a UFB-containing liquid to the buffer tank 1030—the rate of delivery of a UFB-containing liquid to the UFB-containing liquid delivering unit 1040) is produced during the production of a UFB-containing liquid. This excess UFB-containing liquid is accumulated into the buffer tank 1030.

In a case where the production of a UFB-containing liquid is stopped during a process of replacing a constituent element or the like, the UFB-containing liquid accumulated in the buffer tank 1030 is supplied to the UFB-containing liquid delivering unit 1040.

In the present embodiment, in the case of accumulating a UFB-containing liquid, the rate of delivery of a UFB-containing liquid to the buffer tank 1030 is set such that the rate of delivery to the buffer tank 1030≅the rate of delivery to the UFB-containing liquid delivering unit 1040×2.

Also, in a steady state where a UFB-containing liquid is not accumulated, the rate of delivery of a UFB-containing liquid to the buffer tank 1030 is set such that the rate of delivery to the buffer tank 1030≅the rate of delivery to the UFB-containing liquid delivering unit 1040.

By thus setting the rate of delivery of a UFB-containing liquid to the buffer tank 1030, the supply of a UFB-containing liquid can be continued by using the UFB-containing liquid accumulated in the buffer tank 1030 in a case of replacing any of the gas dissolving unit 1203, the UFB generating unit 1205, and the circulating pump 1206. It is therefore possible to perform a process of replacing each constituent element without intermitting the supply of a UFB-containing liquid. Note that simply doubling the rate of delivery of a UFB-containing liquid to the buffer tank 1030 lowers the UFB concentration of the UFB-containing liquid to be supplied from the buffer tank 1030 to the UFB-containing liquid delivering unit 1040. This is because the flow rate of the UFB-containing liquid flowing between the liquid introduction tank 1202 and the buffer tank 1030 doubles whereas the amount of UFBs generated at the UFB generating unit 1205, the amount of the gas dissolved at the gas dissolving unit 1203, and the amount of circulation are the same amounts as those in the steady state.

To address this, in the present embodiment, control is performed that enables production of a UFB-containing liquid and a process of replacing a constituent element to be performed in parallel without lowering the UFB concentration.

Figure 15:
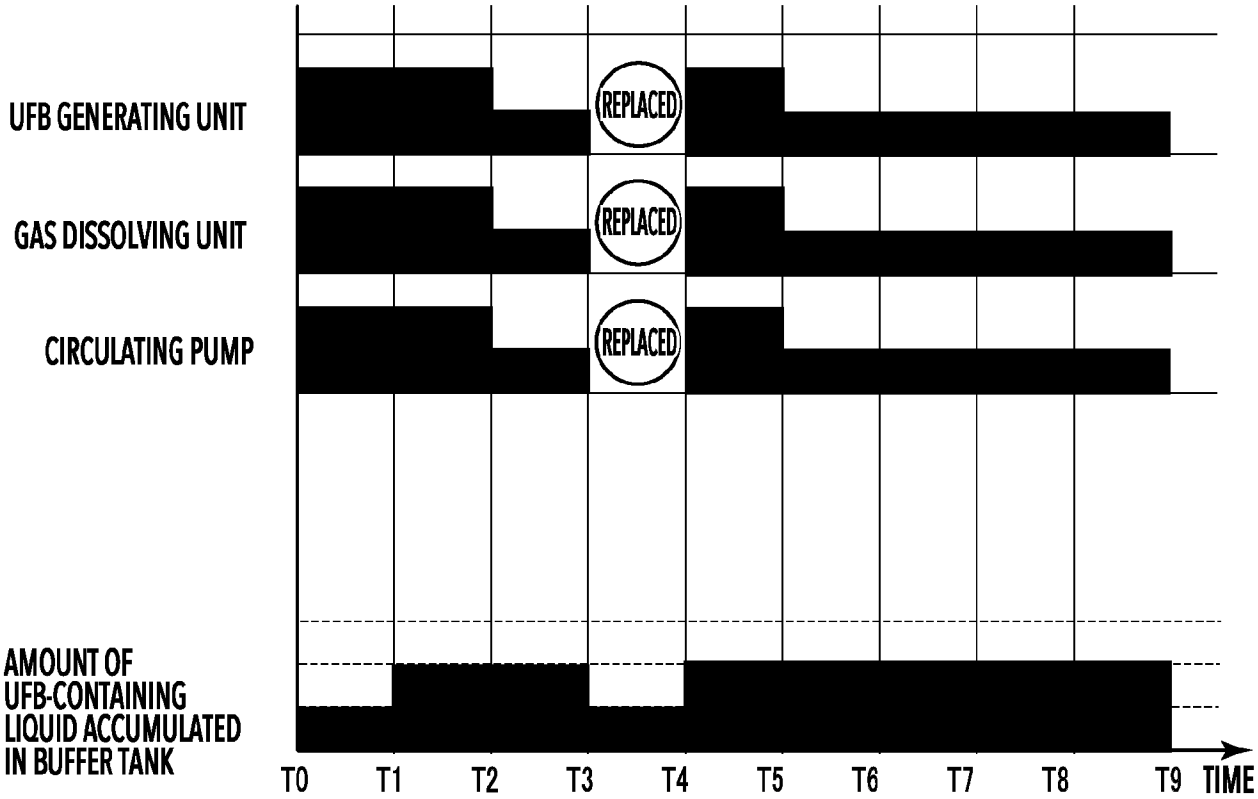
FIG. 15 is a timing chart illustrating control executed in the first embodiment.

FIG. 15 illustrates a timing chart of the control executed in the present embodiment. The vertical axis in in FIG. 15 represents the operation ratio of each of the UFB generating unit 1205, the gas dissolving unit 1203, and the circulating pump 1206 and the amount of the UFB-containing liquid accumulated in the buffer tank 1030. The horizontal axis in FIG. 15 represents the elapse of time. T1 to T9 on the horizontal axis each represent a timing serving as a time reference for the driving of each element, and the time between two adjacent timings is defined as one unit time.

In the present embodiment, the operation ratio of each element in time periods in which the element performs its operation in the steady state (T2 to T3, T5 to T6, T6 to T7, T7 to T8, and T8 to T9) is defined as 100%. This state of being driven at an operation ratio of 100% is a state where the amount of the UFB-containing liquid produced and the amount of the UFB-containing liquid supplied are the same amount, i.e., the above-mentioned state where (the rate of delivery to the buffer tank=the rate of delivery to the UFB-containing liquid delivering unit). In this state, the amount of the UFB-containing liquid accumulated in the buffer tank 1030 remains unchanged.

In time periods in which a UFB-containing liquid is accumulated (T0 to T1, T1 to T2, and T4 to T5), a UFB-containing liquid is delivered from the buffer tank 1030 to the UFB-containing liquid delivering unit 1040 while a UFB-containing liquid is accumulated into the buffer tank 1030. The operation ratio of each constituent element in these periods is set at 200%. In this case, a part of the produced UFB-containing liquid corresponding to 100% is delivered to the UFB-containing liquid delivering unit 1040. Accordingly, a UFB-containing liquid corresponding to 100% is accumulated into the buffer tank 1030 per unit time.

In a case of raising the operation ratio of the UFB generating unit 1205, the driving frequency for the heaters provided in the UFB generating unit 1205 is increased. In the present embodiment, in a case of raising the operation ratio of the UFB generating unit 1205 to 200%, the driving frequency for its heaters is increased to be twice higher. Also, for increasing the operation ratio of the gas dissolving unit 1203, there are a method in which the flow rate of the gas is increased, a method in which the pressure inside the gas dissolving unit is raised, and so on. Further, the operation ratio of the circulating pump 1206 is increased by increasing the rotational speed of the pump to raise the flow rate.

The operation ratio of each constituent element is 0% in the time period from T3 to T4 in which the constituent element is replaced. In this time period too, a UFB-containing liquid corresponding to 100% is delivered from the buffer tank 1030 to the UFB-containing liquid delivering unit 1040, so that the amount of the UFB-containing liquid accumulated in the buffer tank 1030 decreases by an amount corresponding to 100%.

For example, in the time period from T0 to T1, the operation ratio of each constituent element is set at 200% to deliver and accumulate a UFB-containing liquid. Meanwhile, in this example, the maximum amount of accumulation in the buffer tank 1030 is a liquid amount corresponding to an operation ratio of 200%. Then, in the time period from T1 to T2, the amount of the UFB-containing liquid accumulated reaches the maximum amount. Thus, in the time period from T2 to T3, the operation ratio of each element is set at 100% in the steady state. Thereafter, in the time period from T3 to T4, in which the constituent elements are replaced, the operation ratio of each element is 0%, so that no UFB-containing liquid is produced or accumulated. However, the delivery of a UFB-containing liquid to the UFB-containing liquid delivering unit 1040 is continued. Accordingly, the accumulated amount decreases from 200% to 100%. Then, in the timing T4, in which the replacement of the elements is finished, the production and accumulation of a UFB-containing liquid are resumed. In and after the timing T5, in which the accumulated amount reaches 200%, the operation ratio of each element is set at 100% to bring the operation back to the steady state.

As described above, the UFB generating unit 1205, the gas dissolving unit 1203, and the circulating pump 1206 are caused to operate at an operation ratio of 200% in the accumulation period before they reach the replacement timing. As a result, the amount of a UFB-containing liquid to be produced is increased without lowering the UFB concentration, and this UFB-containing liquid is accumulated into the buffer tank 1030. Then, during the replacement of the constituent elements, the accumulated UFB-containing liquid is supplied to the UFB-containing liquid delivering unit 1040. In this way, the production of a UFB-containing liquid and the replacement of the constituent elements can be performed in parallel without lowering the UFB concentration. The replacement timing can be predicted by detecting the state of the UFB generating unit 1205, as described in the method of S403 to be discussed later. Alternatively, the user can set the replacement timing by using a setting unit 6001 to be described later.

Figure 14:
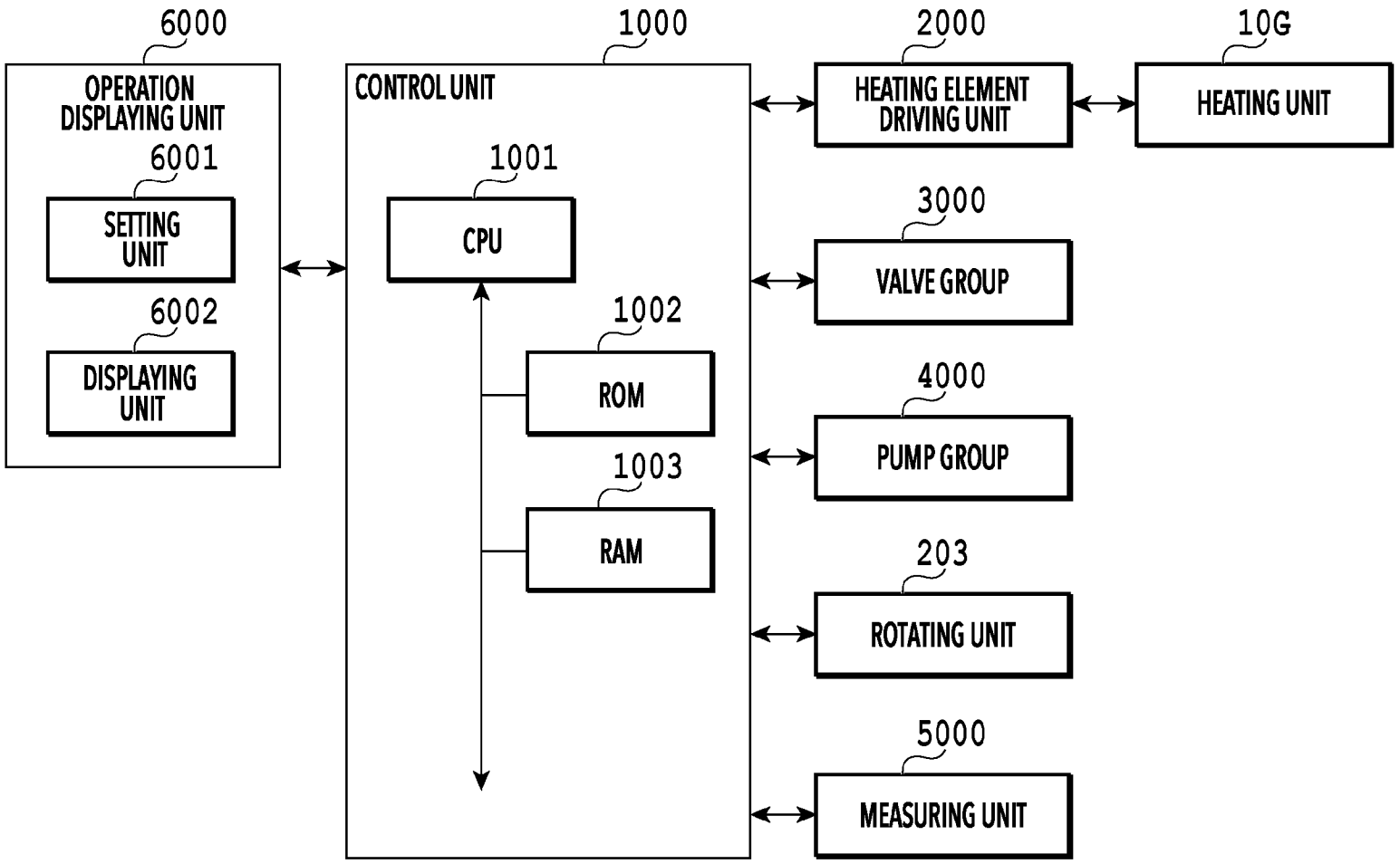
FIG. 14 is a block diagram illustrating a schematic configuration of a control system in the first embodiment.

A schematic configuration of a control system for implementing control as described above will now be described with reference to a block diagram in FIG. 14. In FIG. 14, the control unit 1000 is configured of, for example, a CPU 1001, a ROM 1002, a RAM 1003, and the like. The CPU 1001 functions as a controller that takes overall control of the entire UFB-containing liquid producing apparatus 1A. The ROM 1002 stores a control program to be executed by the CPU 1001, predetermined tables, and other pieces of fixed data. The RAM 1003 has an area to temporarily store various pieces of input data, a work area to be used by the CPU 1001 to execute processes, and the like. An operation displaying unit 6000 includes the setting unit 6001 for the user to configure various settings including the UFB concentration of the UFB-containing liquid, the UFB production time, and the like, and a displaying unit (display unit) 6002 that displays the time required to produce the UFB-containing liquid and the state of the apparatus and performs other similar operations.

The control unit 1000 is connected with a heating element driving unit (driver) 2000 that controls the driving of a plurality of heating elements 10 (see FIG. 5A) of a heating unit 10G provided in an element substrate 12. The heating element driving unit 2000 applies a driving pulse corresponding to a control signal from the CPU 1001 to each of the plurality of heating elements 10 included in the heating unit 10G. Each heating element 10 generates heat corresponding to the voltage, frequency, pulse width, or the like of the applied driving pulse.

The control unit 1000 controls a valve group 3000 including the opening-closing valves or the like provided to the units. The control unit 1000 further controls a pump group 4000 including the various pumps provided in the UFB-containing liquid producing apparatus 1A and motors (not illustrated) and the like provided in the apparatus 1A. The UFB-containing liquid producing apparatus 1A is also provided with a measuring unit 5000 that performs various types of measurement. This measuring unit 5000 includes, for example, a measuring instrument that measures the UFB concentration and flow rate of a UFB-containing liquid that is being produced, a measuring instrument that measures the amount of a UFB-containing liquid accumulated in a buffer tank 1030, and the like. The measured values outputted from this measuring unit 5000 are inputted into the control unit 1000.

Figure 16:
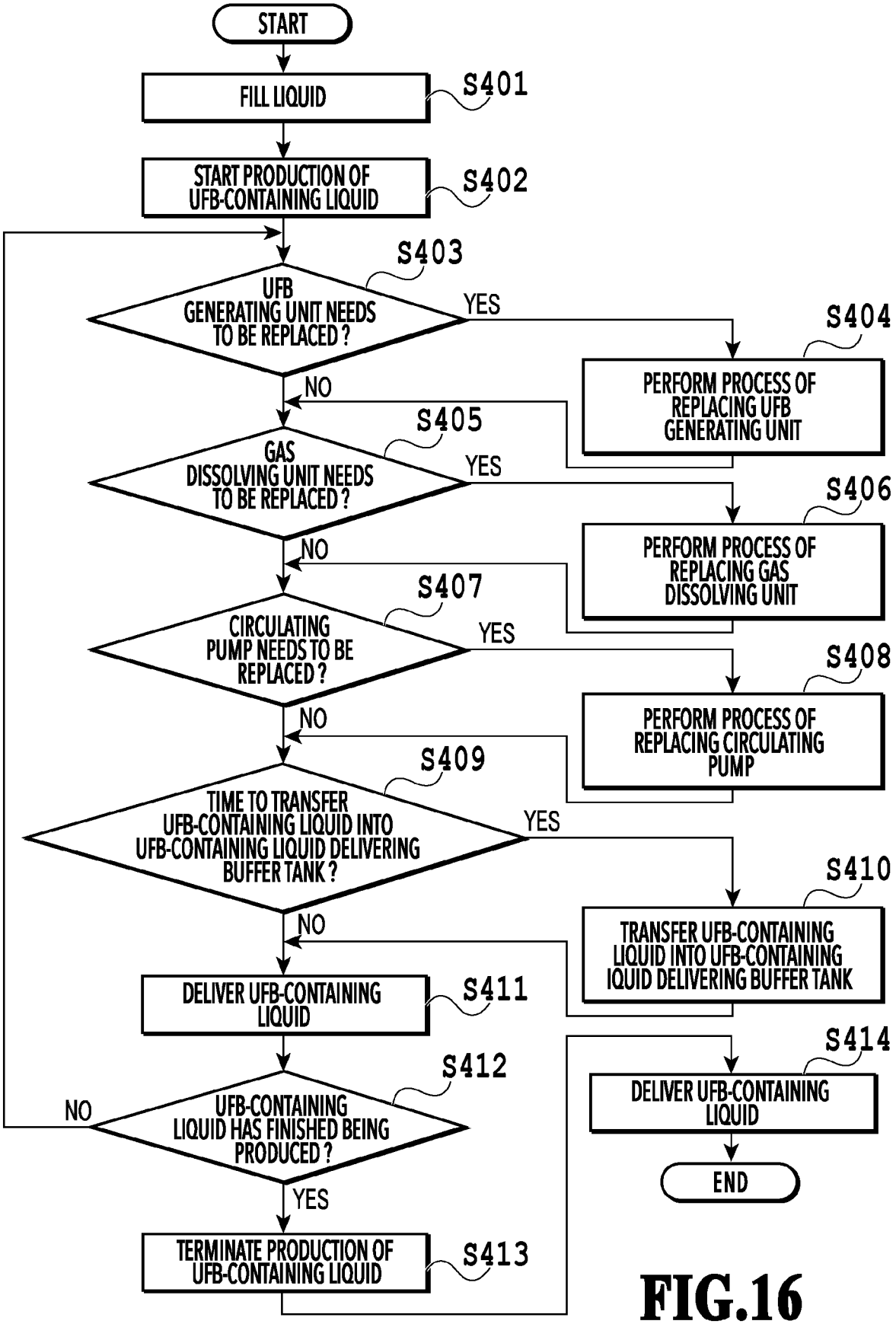
FIG. 16 is a flowchart illustrating a control operation in the first embodiment, and illustrates a main flow.
Figure 17:
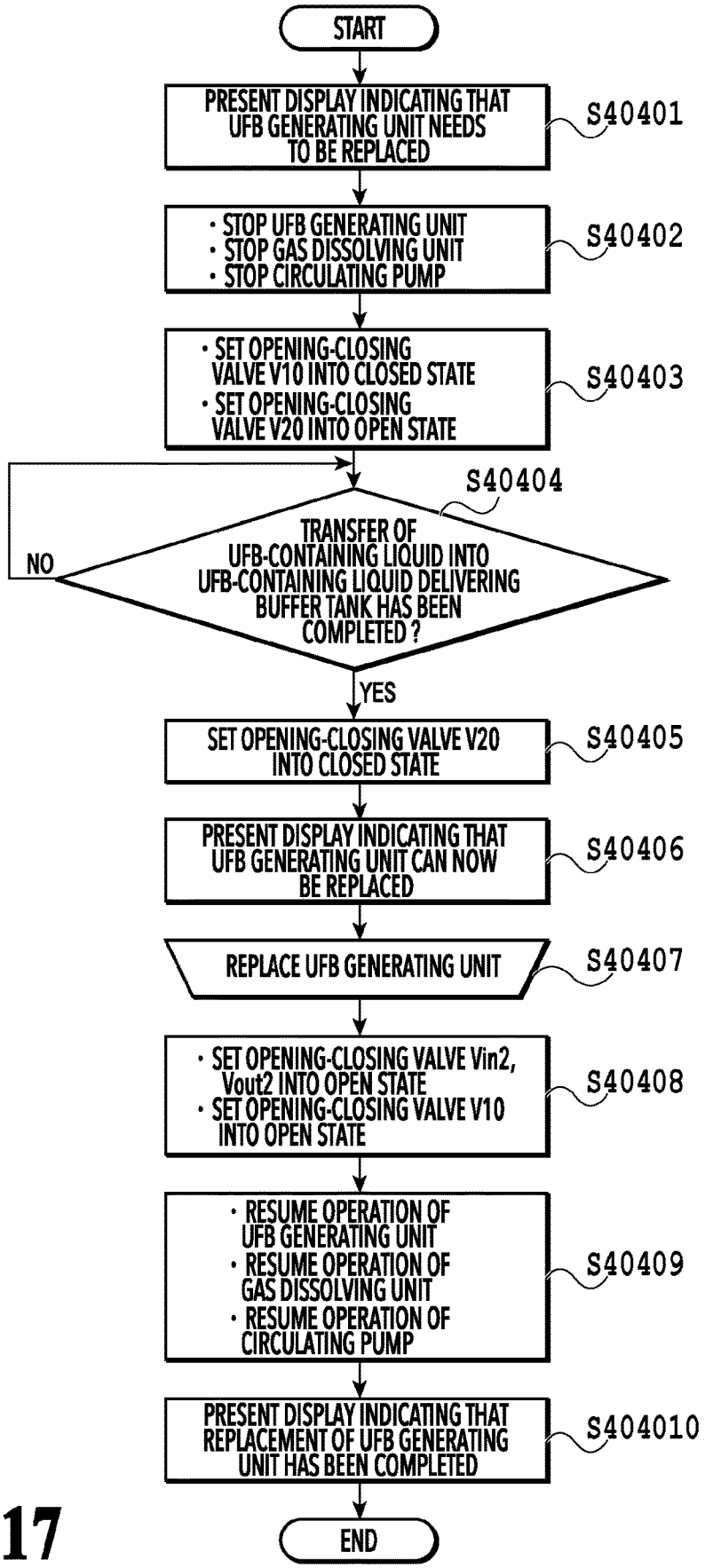
FIG. 17 is a flowchart illustrating the control operation in the first embodiment, and illustrate a sub flow.

FIGS. 16 and 17 are flowcharts illustrating a control operation executed by the control unit 1000 during production of a UFB-containing liquid. FIG. 16 illustrates a main flow, and FIG. 17 illustrates a sub flow. As mentioned earlier, in the present embodiment, control is performed such that in a case where one of the constituent elements of the UFB-containing liquid producing apparatus 1A malfunctions, replacement of the constituent element and production of a UFB-containing liquid are performed in parallel without lowering the UFB concentration. Note that the symbol S attached to each step number in the flowcharts of FIGS. 16 and 17 means a step.

In FIG. 16, a liquid is filled in S401. In this step, of the opening-closing valves illustrated in FIG. 13, the opening-closing valve V10 and the six opening-closing valves connected to the entrances and exits of the respective constituent elements are set into an open state, and only the opening-closing valve V20 is set into a closed state. After the liquid completes being filled into each constituent element, the filling of the liquid is finished with the opening-closing valve V20 set in an open state. Then in S402, production of a UFB-containing liquid is started.

In this step, all of the gas dissolving unit 1203, the UFB generating unit 1205, and the circulating pump 1206 are caused to operate. Then in S403 to S414, it is determined whether the constituent elements need a replacement process, and based on the determination result, a process of replacing a malfunctioning constituent element is performed. Specifically, the following processes are executed.

First, in S403, it is determined whether the UFB generating unit 1205 needs to be replaced. If the determination result is YES (replacement is needed), the operation proceeds to S404. On the other hand, if the determination result is NO (replacement is not needed), the operation proceeds to S405. Note that in the present embodiment, the T-UFB method mentioned in the description of the basic configuration is employed as the UFB generating method for the UFB generating unit 1205. For this reason, methods of determining whether or not the UFB generating unit 1205 needs to be replaced include:

- a method that detects a state in which a predetermined proportion of the heaters provided in the UFB generating unit can no longer heat due to aged deterioration;
- a method that detects a state in which the actual accumulated number of times the generating unit has heated has reached a preset number of times;
- a method that obtains the deterioration in the UFB generation performance of the UFB generating unit 1205 by obtaining the UFB concentration of the UFB-containing liquid produced by the UFB generating unit 1205 with a UFB concentration meter;

and so on.

If it is determined in S403 by a method as above that the UFB generating unit 1205 needs to be replaced, a process of replacing the UFB generating unit 1205 is performed in S404. Details of this replacement process is illustrated in FIG. 17.

In FIG. 17, in S40401, a display indicating that the UFB generating unit 1205 needs to be replaced is presented to notify the user of the fact. Then in S40402, the driving of the UFB generating unit 1205, which is the replacement target, is stopped, and also the driving of the gas dissolving unit 1203 and the circulating pump 1206 is stopped.

Then in S40403, the opening-closing valve V20 on the exit side of the UFB-containing liquid delivery tank 1207 is set into an open state, thereby causing the UFB-containing liquid delivery tank 1207 and the buffer tank 1030 to communicate each other. In this state, the opening-closing valve V10 on the entrance side of the liquid introduction tank 1202 is set into a closed state. As a result, the liquid present between the opening-closing valve V10 and the opening-closing valve V20 flows to the buffer tank 1030.

Then in S40404, it is determined whether the transfer of the UFB-containing liquid into the buffer tank 1030 has been completed. If the determination result is NO (the transfer has not been completed), the transfer of the UFB-containing liquid is continued and the determination in S40404 is repeated. If the determination result is YES (the transfer has been completed), the operation proceeds to S40405.

In S40405, the opening-closing valve V20 on the entrance side of the buffer tank 1030 is set into a closed state, thereby disconnecting the UFB-containing liquid delivery tank 1207 and the buffer tank 1030 from each other. As a result, the UFB generating unit 1205, the gas dissolving unit 1203, and the circulating pump 1206 are isolated from the UFB-containing liquid production route.

Then, in S40406, a display indicating that the isolated UFB generating unit 1205 is now in a replaceable state is presented on the displaying unit 6002 (see FIG. 14) to notify the user of that fact. At this point, a lock mechanism of a cover (not illustrated) covering the UFB-containing liquid production route is unlocked. Then, the operator opens the cover and performs the work of replacing the UFB generating unit 1205 isolated from the UFB-containing liquid production route (S40407).

After the replacement of the UFB generating unit 1205 is finished, the operation proceeds to S4048, in which the opening-closing valves Vin2 and Vout2 connected to the entrance side and exit side of the UFB generating unit 1205 are set into an open state. As a result, the UFB generating unit 1205 is connected to the UFB-containing liquid producing route. Here, entry of unnecessary air into the UFB-containing liquid production route can be reduced by firstly setting the opening-closing valve Vin2 into an open state to introduce the liquid sufficiently and then setting the opening-closing valve Vout2 into an open state. In this operation, the liquid can be introduced quickly by setting an air release opening-closing valve (not illustrated) into an open state. After the replacement, the cover for covering the UFB-containing liquid production route is closed, and then the lock mechanism of the cover is actuated to keep the cover closed.

Further, in the operation proceeds to S40408, the opening-closing valve V10 on the entrance side of the liquid introduction tank 1202 is set into an open state. As a result, the UFB generating unit 1205, the gas dissolving unit 1203, and the circulating pump 1206 are connected to the UFB-containing liquid production route. Here, the valve V10 may be set into the open state with the opening-closing valve V20 kept closed, and then a UFB-containing liquid may be sufficiently introduced. In this way, it is possible to reduce entry of unnecessary air into the UFB-containing liquid production route. In this case too, the liquid can be introduced quickly into the production route by setting the air release valve (not illustrated) into an open state.

Then in S40409, the new UFB generating unit 1205 is caused to start operating, and also the gas dissolving unit 1203 and the circulating pump 1206 are caused to resume operating. In the present embodiment, by the time the operation is resumed, the amount of the UFB-containing liquid accumulated in the buffer tank 1030 has decreased. For this reason, the constituent elements resume operating at an operation ratio of 200%.

Lastly, in S40410, the user is notified that the replacement of the UFB generating unit 1205 has been completed and that the UFB generating unit 1205 has resumed generating UFBs. Then, the operation proceeds to S405 in FIG. 16.

Meanwhile, in the above-described process, the determination process in S40404 may be skipped, and both of the opening-closing valves V10 and V20 may be set into a closed state immediately at the point of S40403 to discharge the liquid present between the opening-closing valves V10 and V20 to the outside through a liquid discharge valve (not illustrated). Doing so can reduce the risk that a UFB-containing liquid that has not reached a predetermined UFB concentration is delivered to the buffer tank 1030. In the discharge, an air release valve (not illustrated) provided upstream can be used to quickly discharge the liquid.

In S405, it is determined whether the gas dissolving unit 1203 needs to be replaced. If the determination result is YES (replacement is needed), the operation proceeds to S406. If the determination result is NO (replacement is not needed), the operation proceeds to S407.

In S406, a process of replacing the gas dissolving unit 1203 is performed. The content of the replacement process is similar to FIG. 17, and description thereof is therefore omitted. However, whether replacement is needed is determined differently from the case of the UFB generating unit 1205, and is determined by using a method in which it is detected whether the operation time of the gas dissolving unit has reached a preset operation life time, or the like. After the replacement process is completed, the operation proceeds to S407.

In S407, it is determined whether the circulating pump 1206 needs to be replaced. If the determination result is YES (replacement is needed), the operation proceeds to S408. If the determination result is NO (replacement is not needed), the operation proceeds to S409.

In S408, a process of replacing the circulating pump 1206 is performed. The content of the replacement process is similar to FIG. 17, and description thereof is therefore omitted. However, whether replacement is needed is determined by using a method in which the state of deterioration in the performance of the circulating pump is obtained with a flow meter (not illustrated), a method in which it is determined whether the actual operation time of the circulating pump has reached a preset operation life time, or the like. After the replacement process is completed, the operation proceeds to S409.

In S409, it is determined whether it is time to transfer a UFB-containing liquid into the buffer tank 1030. If the determination result is YES (it is time to transfer a UFB-containing liquid), the operation proceeds to S410. If the determination result is NO, the operation proceeds to S411.

In S410, a UFB-containing liquid is transferred into the buffer tank 1030. Specifically, the valve V20 is set into an open state. The supply of a UFB-containing liquid to the buffer tank 1030 is resumed in this timing also in the case where the operation is resumed after performing replacement in, e.g., S404, S406, and S408.

Then in S411, a predetermined amount of a UFB-containing liquid is supplied to the UFB-containing liquid delivering unit 1040. Then in S412, it is determined whether a desired amount of a UFB-containing liquid having a desired UFB concentration has completed being produced. If the determination result is NO, the operation proceeds to S403, and the production of a UFB-containing liquid is continued. If the determination result is YES, the operation proceeds to S413.

Then in S413, the production of a UFB-containing liquid is terminated. In this step, the opening-closing valve V10 is closed, and then the gas dissolving unit 1203, the UFB generating unit 1205, and the circulating pump 1206 are stopped. Also, all opening-closing valves except the opening-closing valve V10 are set into an open state (communicating state).

Then in S414, the produced UFB-containing liquid is delivered. After the entire UFB-containing liquid is delivered to the UFB-containing liquid delivering unit 1040, the opening-closing valve V20 is set into a closed state, and the process of producing a UFB-containing liquid is completed. At this point, all opening-closing valves are closed. Meanwhile, the produced UFB-containing liquid can be delivered smoothly by using an air release valve (not illustrated).

As described above, in the present embodiment, before the constituent elements in the apparatus reach their replacement timing, a UFB-containing liquid with a proper UFB concentration is accumulated into the buffer tank 1030 by increasing the operation ratio of each constituent element. Thus, it is possible to continue supplying a proper amount of a UFB-containing liquid with a proper concentration from the buffer tank even during replacement, repair, or the like, during which no UFB-containing liquid can be produced. Hence, according to the present embodiment, replacement or repair of the constituent elements and supply of a UFB-containing liquid can be performed in parallel, which greatly improves the reliability of the apparatus.

Second Embodiment

Next, a second embodiment of the present invention will be described. In the above first embodiment, an example has been described in which a UFB-containing liquid is accumulated in the buffer tank 1030 to enable a UFB-containing liquid with a proper concentration to continue to be supplied even during a process of replacing replacement-target constituent elements. However, there is a possibility of falling into a situation where the supply of a UFB-containing liquid cannot be continued in a case where the gas dissolving unit 1203 and the circulating pump 1206 need to be replaced simultaneously with a process of replacing the UFB generating unit 1205. For example, in a case where a plurality of constituent elements such as the UFB generating unit, the gas dissolving unit, and the circulating pump simultaneously reach a state where they need to be replaced in a situation where only one operator is allocated, it will be difficult to complete the work for all constituent elements within the time period from T3 to T4 in FIG. 15.

To address this, in the present embodiment, control is performed which can also handle a case where constituent elements reach a state where they need to be replaced in the same timing. Note that the present embodiment also has the configuration illustrated in FIGS. 12 to 14.

Figure 18:
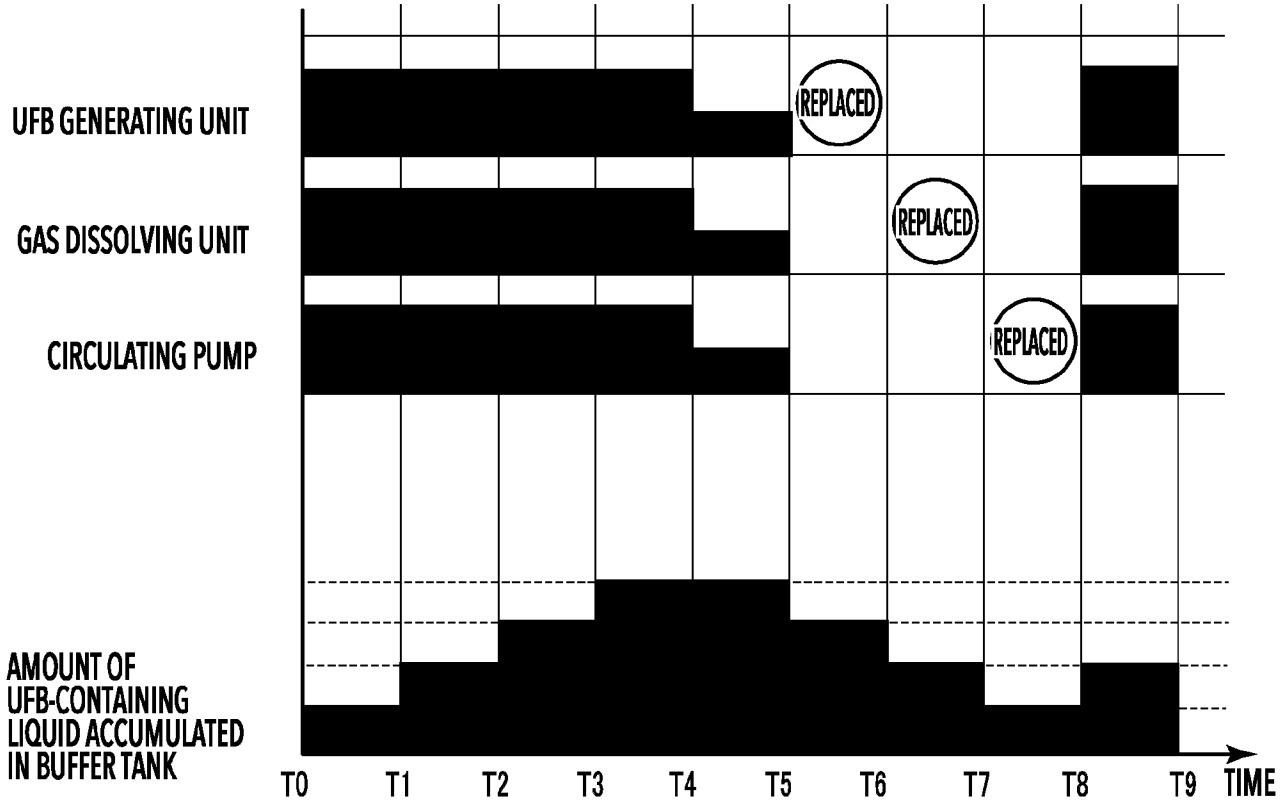
FIG. 18 is a timing chart illustrating control executed in a second embodiment.
Figure 19:
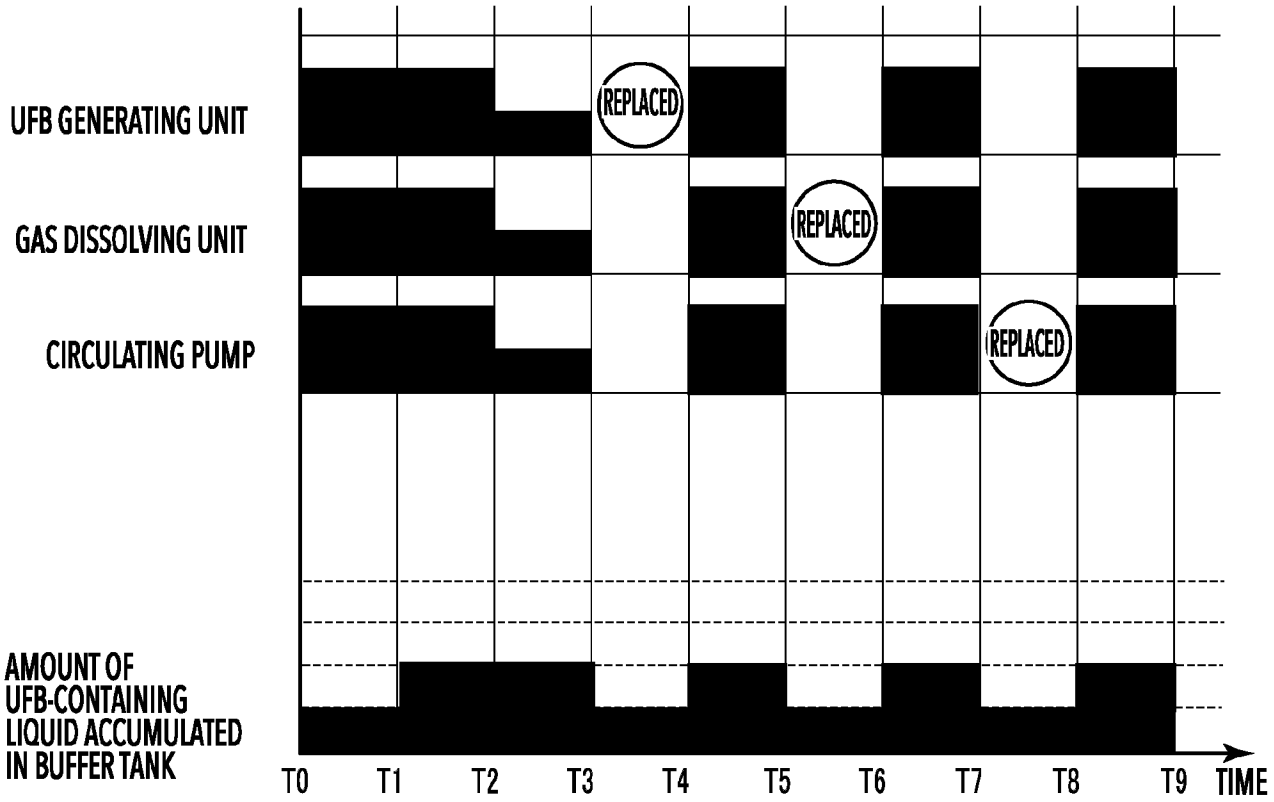
FIG. 19 is a timing chart illustrating control executed in a modification of the second embodiment.

FIGS. 18 and 19 illustrate timing charts of the control executed in the present embodiment. FIG. 18 illustrates an example of control in a case where the UFB generating unit 1205, the gas dissolving unit 1203, and the circulating pump 1206 are replaced in turn. In this example, the maximum amount of a UFB-containing liquid that can be accumulated in the buffer tank 1030 is 400%.

In the time period from T0 to T3, the UFB generating unit 1205, the gas dissolving unit 1203, and the circulating pump 1206 each operate at an operation ratio of 200%. By this operation, a UFB-containing liquid is accumulated into the buffer tank 1030, so that the amount of the UFB-containing liquid accumulated increases by 100% in each of the time periods from T0 to T1, from T1 to T2, and from T2 to T3. In the time period from T3 to T4, the ratio of the accumulation reaches the maximum, or 400%. Thus, in the time period from T4 to T5, the operation ratio is set at 100%.

Then in the time period from T5 to T6, a process of replacing the UFB generating unit 1205 is performed. In this period, the operation ratio of each of the UFB generating unit 1205, the gas dissolving unit 1203, and the circulating pump 1206 is set at 0%. Accordingly, the amount of the UFB-containing liquid accumulated in the buffer tank 1030 decreases by 100% and becomes 300%.

Then in the time period from T6 to T7, the gas dissolving unit 1203 is replaced. In this period, the amount accumulated in the buffer tank 1030 decreases by 100% and becomes 200%. Further, in the time period from T7 to T8, the circulating pump 1206 is replaced. The amount accumulated in the buffer tank 1030 decreases by 100% and becomes 100%. By this point, the replacement of all constituent elements has been completed, and thus the production of a UFB-containing liquid can be resumed.

Then in the timings T8 to T9, an operation of accumulating a UFB-containing liquid into the buffer tank 1030 is performed again. In this period, the operation ratio of each of the UFB generating unit 1205, the gas dissolving unit 1203, and the circulating pump 1206 is set at 200%, and the amount accumulated in the buffer tank 1030 increases by 100% and becomes 200%.

As described above, control is performed so as to accumulate a UFB-containing liquid into the buffer tank 1030 in advance so that a UFB-containing liquid can be supplied from the buffer tank 1030 in the time periods in which processes of replacing the constituent elements are performed individually. In this way, it is possible to continue the supply of a UFB-containing liquid and perform the replacement work in parallel. This makes it possible to perform the replacement work in turn without a delay even in a case where the number of operators for replacement is less than the number of elements to be replaced.

FIG. 18 illustrates control in a case where the UFB generating unit 1205, the gas dissolving unit 1203, and the circulating pump 1206 are replaced continuously. In this case, however, the maximum amount of accumulation needs to be increased according to the number of constituent elements to be replaced. Thus, as the number of replacement-target constituent elements increases, the maximum amount of accumulation needs to be increased accordingly. To solve such a problem, control as illustrated in FIG. 19 can be performed.

FIG. 19 is a timing chart illustrating a modification of the present embodiment in which control is performed so as to enable the UFB generating unit 1205, the gas dissolving unit 1203, and the circulating pump 1206 to be replaced in turn without increasing the maximum amount of accumulation in the buffer tank 1030.

In FIG. 19, the maximum amount that can be accumulated in the buffer tank 1030 is 200%. In the time period from T0 to T2, the UFB generating unit 1205, the gas dissolving unit 1203, and the circulating pump 1206 each operate at an operation ratio of 200%, and a UFB-containing liquid is accumulated into the buffer tank 1030. In each of the time periods from T0 to T1 and from T1 to T2, the amount of the UFB-containing liquid accumulated increases by 100%. In the timings T1 to T2, the ratio of the accumulation reaches the maximum, or 200%, and the operation ratio of each constituent element is therefore set at 100% from T2 to T3.

Then, in the time period from T3 to T4, the UFB generating unit 1205 is replaced. In this period, the operation ratio of each of the UFB generating unit 1205, the gas dissolving unit 1203, and the circulating pump 1206 is set at 0%, and the amount accumulated in the buffer tank 1030 decreases by 100% and becomes 100%.

In the time period from T4 to T5, an operation of accumulating a UFB-containing liquid into the buffer tank 1030 is performed again. In this period, the operation ratio of each of the UFB generating unit 1205, the gas dissolving unit 1203, and the circulating pump 1206 is set at 200%, and the amount accumulated in the buffer tank 1030 increases by 100% and becomes 200%.

Then in the time period from T5 to T6, the gas dissolving unit 1203 is replaced. In this period, the operation ratio of each of the UFB generating unit 1205, the gas dissolving unit 1203, and the circulating pump 1206 is set at 0%, and the amount accumulated in the buffer tank 1030 decreases by 100% and becomes 100%.

Then, in the time period from T6 to T7, an operation of accumulating a UFB-containing liquid into the buffer tank 1030 is performed again. In this period, the operation ratio of each of the UFB generating unit 1205, the gas dissolving unit 1203, and the circulating pump 1206 is set at 200%, and the amount accumulated in the buffer tank 1030 increases by 100% and becomes 200%.

Further, in the time period from T7 to T8, the circulating pump 1206 is replaced. In this period, the operation ratio of each of the UFB generating unit 1205, the gas dissolving unit 1203, and the circulating pump 1206 is set at 0%, and the amount accumulated in the buffer tank 1030 decreases by 100% and becomes 100%.

Then, in the time period from T8 to T9, an operation of accumulating a UFB-containing liquid is performed again. In this period, the operation ratio of each of the UFB generating unit 1205, the gas dissolving unit 1203, and the circulating pump 1206 is set at 200%, and the amount accumulated in the buffer tank 1030 increases by 100% and becomes 200%.

As described above, the amount accumulated in the buffer tank 1030 is controlled to increase before the replacement of each individual constituent element. In this way, it is possible to continue the supply of a UFB-containing liquid and perform the replacement work in parallel. Hence, the maximum amount of accumulation can be kept low irrespective of the number of constituent elements to be replaced.

Meanwhile, in the case of performing the control illustrated in FIG. 19, the replacement timings need to be staggered intentionally. For this reason, in a situation where replacement timings are close to each other, it is preferable to notify the user of that situation and prompt the user to choose either to perform earlier replacement or to stop the production of a UFB-containing liquid and perform replacement.

The description has been given thus far on the assumption that the UFB generating unit 1205, the gas dissolving unit 1203, and the circulating pump 1206 have substantially the same life. In reality, however, each constituent element has a different life.

Thus, in a case where the difference between the remaining lives of constituent elements>the time to be taken to replace an element+the time to be taken to accumulate a UFB-containing liquid, the elements can be replaced by the method illustrated in FIG. 19.

On the other hand, in a case where the difference between the remaining lives of constituent elements<the time to be taken to replace an element+the time to be taken to accumulate a UFB-containing liquid, the first constituent element to reach the end of its life may be replaced earlier. In this way, each replacement process and the supply of a UFB-containing liquid can be performed in parallel.

Third Embodiment

Next, a third embodiment of the present invention will be described with reference to FIG. 20. In the present embodiment, an example will be described in which a circulating pump is disposed for each of a gas dissolving unit and a UFB generating unit, and the gas dissolving unit and the UFB generating unit are connected in parallel to a UFB-containing liquid delivery tank.

Figure 20:
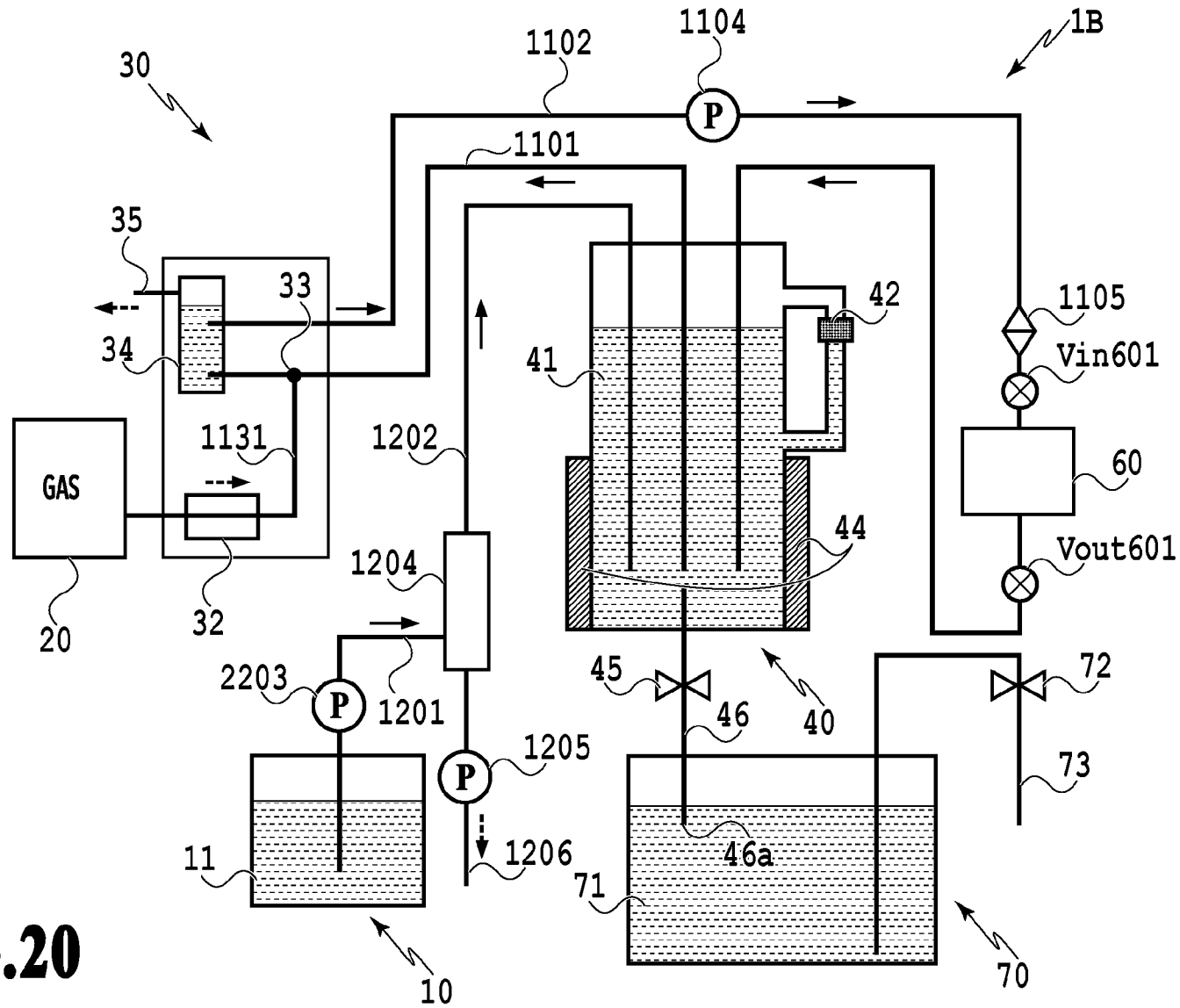
FIG. 20 is a block diagram illustrating a configuration in a third embodiment.

As illustrated in FIG. 20, a UFB-containing liquid producing apparatus 1B in the present embodiment is configured of a liquid supplying unit 10, a gas supplying unit 20, a dissolving unit 30, a first storing chamber 40, a UFB generating unit 60, and a buffer tank 70. These constituent elements are connected by pipes such that a liquid and a gas can move through them. In FIG. 20, each solid arrow represents a liquid flow, and each dotted arrow represents a gas flow.

A liquid 11 is stored in the liquid supplying unit 10. This liquid 11 is supplied by a pump 2203 to the first storing chamber 40 through a route formed of a pipe 1201 and a pipe 1202. Also, a degassing unit 204 is disposed at an intermediate portion of the pipe 1202 to remove gases dissolved in the liquid 11. The degassing unit 1204 incorporates therein a film (not illustrated) which only gases can pass through, and the gases pass through the film to be separated from the liquid. The dissolved gases are sucked by a pump 1205 and discharged from a gas discharging unit 1206. By removing the gases dissolved in the liquid 11 to be supplied in this manner, the later-described desired gas can be dissolved to the maximum extent.

The gas supplying unit 20 has a function of supplying the desired gas to be dissolved into the liquid 11. The gas supplying unit 20 may be a gas cylinder containing the desired gas. Alternatively, the gas supplying unit 20 may be an apparatus capable of continuously generating the desired gas or the like. For example, in a case where the desired gas is oxygen, it is possible to take in the atmospheric air and remove nitrogen, which will be unnecessary, to continuously generate oxygen, and feed the oxygen with an incorporated pump.

The dissolving unit 30 has a function of dissolving the gas supplied from the gas supplying unit 20 into a liquid 41 supplied from the first storing chamber 40. Note that this dissolving unit 30 incorporates a dissolution degree sensor (not illustrated).

The gas supplied from the gas supplying unit 20 is subjected to a process such as electrical discharging at a pre-processing unit 32 and then sent to a dissolving part 33 through a supply pipe 1131. The liquid 41 in the first storing chamber 40 is also supplied to the dissolving part 33 through a pipe 1101. This liquid 41 is supplied by a pump 1104. At the dissolving part 33, the gas is dissolved into the supplied liquid 41. A gas-liquid separating chamber 34 is arranged after the dissolving part 33, and the portion of the gas having failed to be dissolved at the dissolving section 33 is discharged from a gas discharging part 35. The gas-dissolved liquid is collected into the first storing chamber 40 through a pipe 1102.

The first storing chamber 40 stores the liquid 41. Here, the liquid 41 refers more specifically to a mixed liquid of the gas-dissolved liquid in which the gas has been dissolved at the dissolving unit 30 and a UFB-containing liquid produced at the UFB generating unit 60.

The first storing chamber 40 is provided with a liquid level sensor 42. When the surface of the liquid 11 supplied from the liquid supplying unit 10 reaches the liquid level sensor 42, the liquid level sensor 42 outputs a detection signal to a control unit. The control unit having received the detection signal stops the driving of the pump 1104 to stop the supply of the liquid into the first storing chamber 40.

A cooling unit 44 is disposed on the entirety or part of the outer periphery of the first storing chamber 40. This cools the liquid 41. The lower the temperature of the liquid, the higher the solubility of the gas. A lower liquid temperature is therefore preferred, and the liquid temperature is controlled to be about 10° C. or lower by using a temperature sensor (not illustrated).

The cooling unit 44 may have any configuration as long as it can cool the liquid 41 to the desired temperature. For example, a cooling apparatus such as a Peltier device can be employed. Alternatively, a method in which a cooling liquid cooled to low temperature by a chiller (not illustrated) is circulated or the like can be employed. In this case, the configuration may be such that a cooling tube through which the cooling liquid can circulate is attached around the outer periphery or such that the container of the first storing chamber 40 has a hollow structure and the cooling liquid flows therethrough. Alternatively, the configuration may be such that a cooling tube extends through the liquid 41. With the liquid 41 controlled as above to be at low temperature and thus be in a state where the gas easily dissolves into it, the gas can be efficiently dissolved at the dissolving part 33.

Also, a valve 45 is connected to the first storing chamber 40, and a delivery pipe 46 in which an outlet port **46*a* is formed for taking out the UFB-containing liquid is connected to the valve 45. The outlet port 46*a* of the delivery pipe 46 is inserted in the buffer tank 70, and the UFB-containing liquid 41 delivered from the outlet port 46*a* is accumulated into the buffer tank 70. The first storing chamber 40 is provided with a concentration sensor (not illustrated) that measures the UFB concentration of the liquid 41, and the UFB concentration is managed based on the output from the concentration sensor. In a case where the UFB concentration of the liquid 41 reaches a predetermined value, the UFB-containing liquid 41 can be delivered to the buffer tank 70 by opening the valve 45. Note that the outlet port 46*a* may be disposed at a position other than the first storing chamber 40 as long as the buffer tank 70 can receive the UFB-containing liquid from the position. Meanwhile, the first storing chamber 40 may be provided with an agitator or the like for reducing unevenness in the temperature of the liquid 41** and the solubility.

The UFB generating unit 60 has a function of generating UFBs from the gas dissolved in the liquid 41 supplied from the first storing chamber 40 (gas-phase precipitation). The means for generating UFBs may be any means, such as a Venturi method, as long as it can generate UFBs. The present embodiment employs the method that utilizes a film boiling phenomenon to generate UFBs (T-UFB method), in order to efficiently generate highly fine UFBs. In the T-UFB method, a heater is heated to cause film boiling. Here, as mentioned above, the liquid 41 is at a low temperature of about 10° C. or lower. Thus, this liquid 41 has a cooling effect on the UFB generating unit 60 and prevents the UFB generating unit 60 from being hot. This enables a long continuous operation. Note that in a case of a configuration equipped with many heaters, the amount of heat generation is so large that the temperature of the UFB generating unit 60 may rise even if it contacts the liquid 41. In this case, a cooling mechanism may be added to the UFB generating unit 60. As for a specific configuration, it is preferable to employ a configuration as mentioned in the above description of the basic configuration.

The UFB generating unit 60 is supplied with the liquid 41 by the pump 1104 from the first storing chamber 40 through the pipe 1102 and an opening-closing valve Vin601. A filter 1105 that collects impurities, dust, and the like is arranged upstream of the UFB generating unit 60 and the opening-closing valve Vin601 to prevent the impurities, dust, and the like from impairing the UFB generation by the UFB generating unit. Also, a UFB-containing liquid including the UFBs generated by the UFB generating unit 60 is collected into the first storing chamber 40 through an opening-closing valve Vout601 and a pipe.

Note that FIG. 20 illustrates a case where the pump 1104 is disposed upstream of the UFB generating unit 60. However, the arrangement of the pump is not limited to the above. The pump can be provided at a different position as long as it is such a position that a UFB-containing liquid can be efficiently produced. For example, the pump may be disposed downstream of the UFB generating unit 60. Further, pumps may be disposed both upstream and downstream of the UFB generating unit 60.

The buffer tank 70 is capable of receiving a UFB-containing liquid from the outlet port 46*a* and accumulating a certain amount thereof. Also, the buffer tank 70 is provided with an outlet port 73 through which to take out the UFB-containing liquid from the outside, and the UFB-containing liquid can be delivered to the outside by setting a valve 72 into an open state.

In the apparatus configuration described above, the types of the gas and the liquid are not particularly limited, and can be freely selected. Also, portions that contact the gas or the gas-dissolved liquid (such as the gas/liquid contact portions of the pipes 1102, 1102, 1131, 1201, 1202, the pump 1104, 1205, 2203, the filter 1105, and the storing chamber 40 and the UFB generating unit 60) are preferably made of a material with high corrosion resistance. For example, for the gas/liquid contact portions, it is preferable to use a fluorine-based resin such as polytetrafluoroethylene (PTFE) or perfluoroalkoxy alkane (PFA), a metal such as SUS316L, or another inorganic material. In this way, it is possible to generate UFBs in a suitable manner even with a highly corrosive gas and liquid.

Also, a pump whose pulsation and flow rate variation are small is preferably employed as the pump 1104, which causes the UFB-containing liquid in the UFB generating unit 60 to flow, to avoid impairing the UFB generation efficiency. In this way, it is possible to efficiently produce UFB-containing liquids with a small UFB concentration variation.

Next, a UFB generating method in the present embodiment will be described.

As described above, in the UFB-containing liquid producing apparatus 1B in the present embodiment, a circulation route is formed through which the liquid 41 flows as the first storing chamber 40→the dissolving unit 30→the UFB generating unit 60→the first storing chamber 40. With this circulation route, the UFB-containing liquid can be circulated under different conditions as desired. Here, the "conditions" refer to the flow rate of the circulation, the pressure inside the circulation route, the circulation timing, and the like.

For example, after the UFB-containing liquid 41 cools down to a predetermined temperature, the UFB-containing liquid 41 is firstly circulated under a first circulation condition with only the gas supplying unit 20 caused to operate. The first circulation condition is a condition to achieve efficient dissolution of the gas and is set such that the flow rate is approximately 500 to 3000 mL/min and the pressure is about 0.2 to 0.6 MPa.

Here, since the UFB generating unit 60 is present in the same circulation route, bubbles of unintended sizes may be generated in this step in a case of using a method in which the UFB generating unit 60 has portions in a particular shape, such as nozzles, and the liquid is passed through them to generate UFBs.

In the present embodiment, however, the T-UFB method is employed, in which UFBs are generated by utilizing film boiling caused by driving minute heaters. Thus, UFBs are not generated unless the heaters are driven.

After the liquid 41 reaches a desired degree of dissolution, the circulation and the gas supplying unit 20 are stopped. Then, the UFB-containing liquid is circulated under a second circulation condition and the UFB generating unit 60 is driven. In the present embodiment, the second circulation condition is set such that the flow rate is approximately 30 to 150 mL/min and the pressure is about 0.1 to 0.2 MPa. In the T-UFB method, UFBs are generated by utilizing the pressure difference and heat generated in the process from the generation of a bubble by film boiling to the disappearance of the bubble. Accordingly, the circulation conditions is preferably a relatively low flow rate and a relatively low pressure (atmospheric pressure).

Then, after the liquid 41 reaches a desired UFB concentration, the UFB-containing liquid is taken out. In the case of taking out the UFB-containing liquid, the entirety of the UFB-containing liquid in the first storing chamber 40 may be taken out, or only part of it may be taken out. Thereafter, the above-described steps may be repeated until a necessary amount of a UFB-containing liquid is produced.

By circulating the liquid under the different first and second circulation conditions as described above, the dissolution of the gas and the generation of UFBs can be performed under respective optimum conditions. Hence, a high-concentration UFB-containing liquid can be produced efficiently.

With such a configuration, a UFB-containing liquid is accumulated into the buffer tank 70 in a case where the amount of the UFB-containing liquid supplied to the buffer tank 70 from the outlet port 46*a* is greater than the amount delivered from the outlet port 73.

By accumulating a certain amount of a UFB-containing liquid in advance as described above, it is possible to continue delivering a UFB-containing liquid to the outside for a certain period of time even with the valve 45 closed. Specifically, by controlling the valves 45 and 72 as described in table 1, the UFB-containing liquid accumulated in the buffer tank 70 can be used to stably continue supplying a UFB-containing liquid even during replacement of a constituent element(s) of the apparatus.

TABLE 1

| STEP | PROCESS | VALVE 45 | VALVE 72 | FIRST STORING CHAMBER 40 |
|---|---|---|---|---|
| 1 | Accumulate a certain amount of a UFB-containing liquid. | Open state | Closed state | Liquid is present. |
| 2 | Start taking out the UFB-containing liquid to the outside. | Open state | Open state | Liquid is present. |
| 3 | Stop the UFB generation for replacement. | Open state | Open state | Liquid is not present. |
| 4 | Replace an element(s). | Closed state | Open state | Liquid is not present. |
| 5 | Resume the production of a UFB-containing liquid. | Closed state | Open state | Liquid is present. |
| 6 | Resume the accumulation of a UFB-containing liquid. | Open state | Open state | Liquid is present. |

Other Embodiments

In the above embodiments, configurations have been described in which opening-closing valves are provided on both the entrance side and the exit side of each constituent element such as the gas dissolving unit, the UFB generating unit, and the circulating pump to make each constituent element individually switchable between communicating with and being disconnected from the liquid introducing unit and the UFB-containing liquid delivering buffer tank. However, the present invention is not limited to such a configuration. The present invention may just be a configuration in which the entirety of the UFB-containing liquid producing unit including a plurality of constituent elements is capable of switching between communicating with and being disconnected from the liquid introducing unit and the buffer tank. Thus, the UFB-containing liquid producing unit is not limited to one capable of being replaced for the liquid introducing unit and the buffer tank.

In the present invention, the producing unit or its constituent elements only need to be such that the liquid therein can switch between communicating with and being disconnected from the liquid introducing unit and the buffer tank. The producing unit or its constituent elements do not necessarily have to be structurally detachable from the liquid introducing unit and the buffer tank. That is, even in a case where the producing unit or its constituent elements are not replaceable or detachable, the present invention is useful in performing work such as repair or adjustment in a state where the producing unit or its constituent elements are connected or fixed to the apparatus.

Also, the present invention is applicable to UFB-containing liquid producing apparatuses as long as they are capable of controlling the amount of UFBs to be generated, and is applicable to UFB-containing liquid producing apparatuses using UFB generation methods other than the T-UFB method.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-199386 filed Oct. 31, 2019, which is hereby incorporated by reference wherein in its entirety.

What is claimed is:

1. An ultrafine bubble-containing liquid producing apparatus comprising:

a producing unit that generates ultrafine bubbles in a liquid supplied from a liquid introducing unit to thereby produce an ultrafine bubble-containing liquid containing the generated ultrafine bubbles, and delivers the produced ultrafine bubble-containing liquid;

a liquid delivering unit that delivers the produced ultrafine bubble-containing liquid to an outside;

a buffer tank that receives the liquid delivered from the producing unit and delivers the received liquid to the liquid delivering unit; and a controller that controls the delivery of the ultrafine bubble-containing liquid from the buffer tank to the liquid delivering unit such that, in a case where the producing unit stops operating, the ultrafine bubble-containing liquid accumulated in the buffer tank is delivered to the liquid delivering unit to thereby enable the liquid delivering unit to deliver the ultrafine bubble-containing liquid to the outside.

2. The ultrafine bubble-containing liquid producing apparatus according to claim 1, wherein the controller controls the producing unit such that the ultrafine bubble-containing liquid is accumulated into the buffer tank in a predetermined time period before operation of the producing unit is stopped.

3. The ultrafine bubble-containing liquid producing apparatus according to claim 2, wherein the controller controls an amount of the ultrafine bubble-containing liquid to be delivered from the producing unit in the predetermined time period according to a time period in which the operation of the producing unit is stopped.

4. The ultrafine bubble-containing liquid producing apparatus according to claim 2, wherein the controller controls a rate of delivery of the ultrafine bubble-containing liquid to be delivered from the producing unit.

5. The ultrafine bubble-containing liquid producing apparatus according to claim 4, wherein the controller controls the producing unit such that the rate of delivery of the ultrafine bubble-containing liquid to be delivered from the producing unit in the predetermined time period is higher than a rate of delivery of the ultrafine bubble-containing liquid to be delivered from the buffer tank in the predetermined time period.

6. The ultrafine bubble-containing liquid producing apparatus according to claim 2, wherein the controller controls the producing unit such that a rate of delivery of the ultrafine bubble-containing liquid to be delivered from the producing unit in the predetermined time period is higher than a rate of delivery of the ultrafine bubble-containing liquid to be delivered from the producing unit in a time period different from the predetermined time period.

7. The ultrafine bubble-containing liquid producing apparatus according to claim 1, wherein a time period in which operation of the producing unit is stopped is a time period in which a constituent element provided in the producing unit is replaced or repaired, and wherein the controller causes the producing unit to operate in a case where replacement or repair of the constituent element is completed.

8. The ultrafine bubble-containing liquid producing apparatus according to claim 2, wherein the producing unit includes a plurality of constituent elements, and wherein the controller controls a rate of delivery of the ultrafine bubble-containing liquid to be delivered from the producing unit in the predetermined time period according to a time period in which the plurality of constituent elements are replaced or repaired in turn continuously.

9. The ultrafine bubble-containing liquid producing apparatus according to claim 8, wherein the controller sets timings for replacing or repairing the plurality of constituent elements respectively with a predetermined time interval therebetween, and controls the rate of delivery of the ultrafine bubble-containing liquid to be delivered from the producing unit so as to increase an amount of the ultrafine bubble-containing liquid accumulated in the buffer tank in each of predetermined time periods preceding the replacement or the repair of the respective constituent elements.

10. The ultrafine bubble-containing liquid producing apparatus according to claim 9, wherein the controller determines the predetermined time interval based on lives of the constituent elements.

11. The ultrafine bubble-containing liquid producing apparatus according to claim 1, wherein the producing unit includes an ultrafine bubble generating unit that generates the ultrafine bubbles in the liquid supplied from the liquid introducing unit, wherein, in a case where the ultrafine bubble generating unit is replaced or repaired, the controller stops the supply of the liquid from the liquid introducing unit to the ultrafine bubble generating unit and operation of the ultrafine bubble generating unit while delivering the ultrafine bubble-containing liquid from the buffer tank, and wherein, after the ultrafine bubble generating unit is replaced or repaired, the controller resumes the supply of the liquid from the liquid introducing unit to the ultrafine bubble generating unit and the operation of the ultrafine bubble generating unit and also resumes the delivery of the ultrafine bubble generating unit to the buffer tank.

12. The ultrafine bubble-containing liquid producing apparatus according to claim 11, wherein the producing unit further includes:

a gas dissolving unit that dissolves a gas into the liquid supplied from the liquid introducing unit; and a circulating pump that circulates a liquid delivered from the ultrafine bubble generating unit, wherein, in a case where the ultrafine bubble generating unit is replaced or repaired, the controller stops the supply of the liquid from the liquid introducing unit to the ultrafine bubble generating unit and operation of the gas dissolving unit, the ultrafine bubble generating unit, and the circulating pump while delivering the ultrafine bubble-containing liquid from the buffer tank, and wherein, after the ultrafine bubble generating unit is replaced or repaired, the controller delivers the liquid from the liquid introducing unit to the ultrafine bubble generating unit and resumes the operation of the gas dissolving unit, the ultrafine bubble generating unit, and the circulating pump and also resumes the delivery of the ultrafine bubble generating unit to the buffer tank.

13. The ultrafine bubble-containing liquid producing apparatus according to claim 11, wherein the ultrafine bubble generating unit generates the ultrafine bubbles in the liquid with a heating element that causes film boiling in the liquid.

14. The ultrafine bubble-containing liquid producing apparatus according to claim 12, wherein the ultrafine bubble generating unit generates the ultrafine bubbles in the liquid with a heating element that causes film boiling in the liquid.

15. An ultrafine bubble-containing liquid producing method comprising:

generating, with a producing unit, ultrafine bubbles in a liquid supplied from a liquid introducing unit to thereby produce an ultrafine bubble-containing liquid containing the generated ultrafine bubbles, and delivering the produced ultrafine bubble-containing liquid from the producing unit;

delivering the produced ultrafine bubble-containing liquid to an outside from a liquid delivering unit;

receiving the ultrafine bubble-containing liquid delivered from the producing unit into a buffer tank and delivering the received liquid from the buffer tank to the liquid delivering unit; and controlling the delivery of the ultrafine bubble-containing liquid from the buffer tank to the liquid delivering unit such that, in a case where operation of the producing unit is stopped, the ultrafine bubble-containing liquid accumulated in the buffer tank is delivered to the liquid delivering unit to thereby enable the liquid delivering unit to deliver the ultrafine bubble-containing liquid to the outside.

* * * * *